US008810397B2

(12) United States Patent
Wieser

(10) Patent No.: US 8,810,397 B2
(45) Date of Patent: Aug. 19, 2014

(54) APPARATUS AND METHOD FOR MONITORING A BUILDING OPENING

(76) Inventor: Stefan Wieser, Gerasdorf bei Wien (AT)

( * ) Notice: Subject to any disclaimer, the term of this patent is extended or adjusted under 35 U.S.C. 154(b) by 173 days.

(21) Appl. No.: 13/512,333

(22) PCT Filed: Jan. 11, 2011

(86) PCT No.: PCT/AT2011/000007

§ 371 (c)(1),
(2), (4) Date: May 27, 2012

(87) PCT Pub. No.: WO2011/085420

PCT Pub. Date: Jul. 21, 2011

(65) Prior Publication Data

US 2012/0268274 A1 Oct. 25, 2012

(30) Foreign Application Priority Data

Jan. 18, 2010 (AT) ..... A 58/2010
Feb. 16, 2010 (AT) ..... A 231/2010
Feb. 16, 2010 (AT) ..... A 232/2010
Mar. 4, 2010 (AT) ..... A 347/2010

(51) Int. Cl.
*G08B 13/08* (2006.01)

(52) U.S. Cl.
USPC ..... 340/545.2; 340/545.1; 340/545.9; 340/541

(58) Field of Classification Search
USPC ..... 340/545.2, 545.1, 545.8, 545.9, 541, 340/565; 348/148, 152, 207, 209; 382/207, 382/209; 250/216, 227.14, 227.23, 227.26
See application file for complete search history.

(56) References Cited

U.S. PATENT DOCUMENTS

| | | | | |
|---|---|---|---|---|
| 6,075,238 | A | 6/2000 | Fembok | |
| 6,456,320 | B2 * | 9/2002 | Kuwano et al. | 348/143 |
| 6,841,780 | B2 * | 1/2005 | Cofer et al. | 250/341.1 |
| 8,514,076 | B2 * | 8/2013 | Piper et al. | 340/555 |
| 2003/0118237 | A1 | 6/2003 | Laird | |
| 2007/0131850 | A1 | 6/2007 | Cofer et al. | |
| 2008/0300816 | A1 | 12/2008 | Tsai et al. | |
| 2009/0207016 | A1 | 8/2009 | Laackmann et al. | |

FOREIGN PATENT DOCUMENTS

| | | | |
|---|---|---|---|
| DE | 195 25 875 | A1 | 1/1997 |
| DE | 101 09 750 | A1 | 9/2001 |
| DE | 100 47 896 | A1 | 4/2002 |
| DE | 102 02 660 | A1 | 7/2003 |
| DE | 10 2004 035 243 | A1 | 2/2006 |
| DE | 10 2007 012 314 | A1 | 9/2007 |
| EP | 0 299 219 | A1 | 1/1989 |
| EP | 0 747 868 | A1 | 12/1996 |
| EP | 1 079 351 | A1 | 2/2001 |
| EP | 1 168 269 | A2 | 1/2002 |
| EP | 1 246 148 | A2 | 10/2002 |
| EP | 2 019 378 | A2 | 1/2009 |
| GB | 2 404 479 | A | 2/2005 |
| JP | 2005165376 | A | 6/2005 |

* cited by examiner

*Primary Examiner* — Hung T. Nguyen

(57) ABSTRACT

The invention specifies an apparatus and a method for monitoring a building opening which is closed with a closure element (6, 6*a* . . . 6*n*) which is not fully transparent. The apparatus comprises a pattern (M), which is arranged on one side of the closure element (6, 6*a* . . . 6*n*) or is projected onto this side, and a detection unit (7*a* . . . 7*e*) which is aligned with this pattern (M). A comparison unit compares the actual pattern (M) detected by the detection unit (7*a* . . . 7*e*) with a desired pattern and triggers an alarm if the difference between the actual pattern (M) and the desired pattern exceeds a predefinable threshold.

15 Claims, 13 Drawing Sheets

APPARATUS AND METHOD FOR MONITORING A BUILDING OPENING

This application claims benefit of foreign priority to Austrian application no. AT 58/2010 filed on Jan. 18, 2010, AT 231/2010 filed on Feb. 16, 2010, AT 232/2010 filed on Feb. 16, 2010 and 347/2010 filed on Mar. 4, 2010; all named applications are expressly incorporated herein by reference in their entireties for all intents and purposes, as if fully set forth identically herein.

TECHNICAL FIELD

The invention relates to an apparatus for monitoring a building's opening, which is closed by a non-completely transparent closure element. Moreover, the invention relates to a method for monitoring a building's opening, which is closed by a non-completely transparent closure element.

STATE OF THE ART

Unfortunately, the number of burglaries accumulates in the present time, why a variety of security monitoring systems for buildings has been developed. For example, doors and windows can be equipped with contacts that detect unauthorized opening thereof. Moreover, breakage sensors report the breaking of a glass pane. Furthermore, also motion detectors, photocells and safety mats are often used to monitor certain areas in and around buildings.

The aim of all these measures is to prevent an intrusion into a building. Unfortunately, practice shows that the mere securing of windows usually reports an intrusion, but cannot prevent it. Because once a window is broken, the threshold for the criminal not to enter the building—despite the triggered alarm—usually is extremely low. Normally, a few minutes are sufficient for a burglar. This is often shorter than the time it takes for the police to arrive at the scene. Frequent false alarms moreover result in a state, in which the public does not even respond to an alarm.

In addition to the aforementioned motion sensors, light barriers and safety mats there also exist cameras for some time, which trigger an alarm if a person is detected with an additional sensor (mostly a passive infrared sensor, PIR sensor for short) or the difference between an image captured by the camera and a reference image exceeds a predetermined threshold. In this manner, potential burglars, who come into the detection range of the above arrangement, can be detected. Accordingly, an alarm is triggered and/or an image recording is started.

The problem is, for example, that animals often cause false alarms. Furthermore, merely approaching a building usually cannot be seen as a burglary attempt. In other words not every person, who enters the detection range of a camera or a sensor, necessarily represents a potential burglar. Accordingly, an image recording is started for nothing in most cases respectively a false alarm is triggered.

Generally speaking, prior art sensors lying outside my easily be manipulated. For example, motion detectors can be sprayed with color or light barriers can be bridged. Often the residents of the buildings—tired of frequent false alarms—disable the outer sensors what undermines the use of an alarm system.

Even the securing of, for example, shutters, which is well-known in the prior art, cannot prevent a burglary. For example, mechanical lockings for manually operated roller shutters are known in the form of special clamps. Motorized roller shutters are also secured through the transmission, which blocks in the case of unauthorized shifting of the shutter. Additional security can also be provided by a magnetic contact, which detects a shifting of the shutter.

The problem here is that burglars often simply cut open the shutter or tear them out of the anchorage. A mechanical locking is meaningless in such a case. Likewise, a magnet contact does not trigger an alarm, when the lamella, to which the magnet or contact is attached, is not moved.

In a similar way, also rolling doors, folding shutters and doors may be secured respectively broken according to the state of the art.

DISCLOSURE OF THE INVENTION

Object of the invention is therefore to provide an improved apparatus and an improved method for monitoring a building's opening, especially one to detect an intrusion attempt relatively early, wherein the risk of false alarms and manipulation however is small.

According to the invention this object is achieved by a device of the type defined above comprising:

a pattern arranged on one side of the closure element or projected onto it, a detection unit directed to this pattern and a comparison unit for comparing the actual pattern detected by the detection unit with a reference pattern and for triggering an alarm if the deviation between the actual pattern and the reference pattern exceeds a predetermined threshold.

Furthermore, this object is achieved by a method of the type mentioned above, comprising the steps of:

capturing a pattern arranged on one side of the closure element or projected onto it, comparing the detected actual pattern with a reference pattern and trigger an alarm if the deviation between the actual pattern and the reference pattern exceeds a predetermined threshold.

Advantageously, the side of the closure element facing the interior of the building is provided with a pattern that is detected by a detection unit. A comparison unit compares the detected actual pattern with a stored reference pattern and triggers an alarm when the actual pattern and reference pattern strongly deviate.

Preferably a roller shutter, a roller door, a blind (jalousie), a raffstore blind, a fabric roller blind, a folding shutter or a door is provided as the closure element.

Alternatively, the object of the invention can be solved by an arrangement for monitoring a building's opening, comprising:

a transparent pane arranged in this opening, a closure element, which is non-completely transparent and arranged in said opening at the building's outside in relation to the pane, a camera arranged at the building's inside in relation to the pane, a) a sensor for detecting a person in the area observed by the camera and/or b) a comparison unit for comparing an actual image captured by the camera with an reference image, means for triggering an alarm and/or an image recording by the camera, if in case a) a person is detected and/or in case b) the deviation between the actual image and the reference image exceeds a predetermined threshold, wherein the camera is directed to the closure element in a way that the observed image area essentially shows the closure element.

Similarly, the problem of the invention is solved by a camera, comprising:

an image sensor, a) a sensor for detecting a person in the area observed by the camera and/or b) a comparison unit for comparing an actual image captured by the camera with an reference image, means for triggering an alarm and/or an image recording by the camera, if in case a) a person is detected and/or in case b) the deviation between the actual image and the reference image exceeds a predetermined threshold, wherein means for attaching the camera on a transparent pane are provided such that a closure element, which is arranged in said opening at the building's outside in relation to the pane, can be observed by the camera.

Similarly, the problem of the invention is solved by a method for monitoring a building's opening, wherein an alarm and/or an image recording is triggered by a camera if a) a person is detected by a sensor for detecting a person in the area observed by the camera and/or b) a deviation between an actual image detected by the camera and a reference image exceeds a predetermined threshold, wherein the camera is arranged at the building's inside in relation to a transparent pane being arranged in a building's opening, wherein a closure element, which is non-completely transparent, is arranged in said opening at the building's outside in relation to the pane and wherein the camera is directed to the closure element in a way that the observed image area essentially shows the closure element.

Further alternatively, the object of the invention can also be achieved by an arrangement for monitoring a building's opening, comprising:

a window arranged in this opening, a closure element arranged in said opening at the building's outside in relation to the window, at least one sensor arranged on or in a component of the window, a comparison unit for comparing an actual signal detected by the at least one sensor with a reference signal, means for triggering an alarm if the deviation between said actual signal and said reference signal exceeds a predetermined threshold, wherein the at least one sensor is directed to the closure element in a way that the observed area essentially covers the closure element.

Likewise, the object of the invention furthermore is achieved by a method for monitoring a building's opening, wherein an alarm is triggered when a deviation between an actual signal detected by at least one sensor and a reference signal exceeds a predetermined threshold, wherein the at least one sensor is arranged on or in a component of a window, which is located in a building's opening, wherein a closure element is arranged in said opening at the building's outside in relation to the window and wherein the at least one sensor is directed to the closure element in a way that the observed area essentially covers the closure element.

Finally, the invention is equally solved by a window to be installed into a building's opening, comprising at least one sensor arranged on or in a component of the window, wherein the at least one sensor is directed in a way that the observed area essentially covers a closure element, which is arranged in said opening at the building's outside in relation to the window.

According to the invention it is achieved that the at least one detection unit, the camera or the sensor triggering the camera detects a predominantly static object. Thus, persons outside the protected object cannot cause a false alarm, if the closure element is closed. If the at least one detection unit is arranged in or on the window, moreover the likelihood that people in the interior of the monitored object cause a false alarm, is very low. However, if the area observed by the at least one detection unit, the camera or a sensor triggering the camera basically covers the closure element, the security to detect an intrusion is not affected.

The present invention overcomes several disadvantages of the prior art.

An unauthorized sliding or opening of the closure element is reliably detected.

Cutting out or tearing out the closure element is reliably detected.

Animals or people, who are only in the proximity of the building, do not trigger a (false) alarm.

An attempted burglary is detected a long time before a criminal can gain entry to the building.

The inventive device is tamper-proof, because the criminal in the case of a shutter neither in the open state of the shutter (shutter is in the shutter box) nor in the closed state of the shutter (only the outside is visible) can get knowledge about the monitored inside of the shutter. Thus, the invention is particularly suitable for rolling shutters and rolling doors.

Covering the detecting unit, for example, by spraying with paint is useless, since this also leads to activation of an alarm.

The inventive system can also easily be retrofitted to existing closure elements and is particularly suitable for subsequent safeguarding of closure elements with a lower-class resistance (i.e. elements that provide only little protection against burglary).

In the context of the invention, "non-completely transparent" means that the closure element reflects at least a minimum level of electromagnetic radiation in a given wavelength range, preferably light in the visible range. This definition thus naturally covers also reflecting surfaces.

A "sensor" is a component that can capture certain physical properties, in particular light in the visible and invisible wavelengths. In particular, a "sensor" means a single light-sensitive cell.

In the context of the invention, a "camera" means a camera working both in the visible and in the invisible wavelength range, for example in the infrared region. Generally, a camera includes a collection of light-sensitive cells, optionally with an upstream optical system. In this sense, a multi-zone passive infrared sensor (PIR sensor) may also be interpreted as a camera. The boundaries between the terms "sensor" and "camera" are thus blurred.

A "detection unit" in the simplest case includes a sensor and/or a camera. The detection unit may also comprise other components, particularly a light source and an electronic circuit for controlling the sensor/the camera and/or preparation of the signal acquired by the sensor or the camera. If the detection unit in addition comprises a comparison unit for comparing an actual signal with a reference signal and the means for triggering an alarm, then the detection unit provides the function of an alarm sensor. The boundaries between the terms "sensor", "camera", "acquisition unit" and "alarm generator" are thus blurred, so that said terms may be replaced with each other in the following discussion if necessary.

An "actual signal" is a signal currently acquired by the detection unit. A "reference signal" accordingly is a stored reference signal, which for example is stored during manufacture of the inventive device or the installation thereof. A reference signal furthermore can be any actual signal from the detection unit lying in the past. The meaning of an "actual image" captured by a camera and a "reference image" is similar. The boundaries between "actual signal" and "actual image" or between "reference signal" and "reference image"

are blurred again, so that said terms may be replaced with each other in the following discussion if necessary.

Advantageously, the detection unit is suitable for detecting a pattern on a closure element, i.e. a set of values of a physical property that are of different size in two different locations on the closure element. For example, the brightness of the closure element can be used as a physical property. A pattern would then be given by various bright and dark areas. Likewise, also a color of the closure element could be used as a physical property, whereby a pattern would be characterized by different color areas. For example, a single photo sensor directed to the closure element, which evaluates the reflectivity of a stationary closure element only at a single point and which thus does not evaluate a combination of bright and dark areas, therefore is not suitable for detecting a pattern on a closure element for the purposes of the invention.

Advantageous embodiments and further developments of the invention will now arise from the dependent claims and from the description in conjunction with the accompanying drawings.

It is advantageous, if a bar code is provided as pattern, a barcode reader is provided as a detection unit, and the comparison unit is provided for comparing an actual code with a reference code. Bar code readers are proven and readily available equipment why the invention may be implemented with little technical effort on the one hand and why it is also little error prone on the other hand. When a bar code is used, a particular symbol respectively a sequence of symbols is assigned to a sequence of light and dark areas, such as "AXZ78". In this variant of the invention, the actual code is compared with a reference code, for example, an actual sequence of symbols with a reference sequence. Advantageously, the computational effort to compare the actual pattern with the reference pattern in coded form and the required storage capacity for storing the symbol based on the pattern is very low. Thus, the invention can be implemented with very little technical effort. Of course, the actual pattern can also be compared with a reference pattern as such, that is to say without assigning it to one or more symbols, i.e. to encode it.

It is also advantageous in case of a bar code when it is scanned column by column. In case of wider bar codes a change thus can be detected in a smaller area of the code, for example to detect also smaller access holes through the closure element. For example, also insects crawling on the closure element can be masked, for example, if alarm is triggered only when a deviation of the actual pattern from the reference pattern is found in multiple columns.

It is also advantageous if a two-dimensional code it is provided as a pattern, a reader for a two-dimensional code is provided as a recording unit and the comparison unit is provided for comparing the actual code with a reference code. This variant of the invention is similar to the variant of the invention, in which a bar code is used to monitor the closure element. Two-dimensional codes are known per se and are therefore not explained in detail at this point. Also in this variant, the comparison can be made on the basis of the pattern itself or on the basis of symbols derived thereof.

It is also especially advantageous if an image of a scene is provided as a pattern, a camera directed to said image is provided as an optical detection unit, and the comparison unit is provided for comparing an actual image with a reference image. In this way, an image of a scene, for example, a photo (color, grayscale or black and white picture) can be used for monitoring a closure element instead of bar codes or two-dimensional codes, which appear very technical and are little decorative. In this way, a double benefit can be achieved, because on the one hand, a building's opening can be monitored, on the other hand, the inside of the closure element can fulfill a decorative purpose. For example, a mountain landscape can displayed on it. However, the image attached on the closure element should not match the image that is captured by the detection unit with the closure element being open, as opening or breaking the closure element may be remains undetected then.

It is particularly advantageous if the pattern substantially extends over the entire length of the closure element seen in a direction of movement of the same. In this way, virtually the entire closure element can be monitored, so that the cutting out or tearing out of individual parts of the closure element does not remain unnoticed.

It is particularly advantageous if the pattern that is intended for detection by the detecting unit substantially extends over the entire surface of the closure element. In this way, virtually the entire surface of the closure element can be monitored on unauthorized opening or destruction.

It is beneficial if the detection unit/the camera is directed to the closure element in a way that the observed area exclusively covers the closure element or the captured image exclusively shows the closure element. In this way, the likelihood that people in the interior of the monitored object trigger an unwanted image recording or a false alarm can be further reduced. However, the security to detect an intrusion attempt is not affected thereby.

Furthermore, it is particularly advantageous if the region of the closing element, which is free from a bar code, a two-dimensional code or an image of a scenery is smaller than a trapdoor opening of an intruder. It is also particularly advantageous if the at least one sensor of a detection unit or a sensor arranged on a window is directed to the closure element in a way that the observed area covers a portion of the closure element, and the non-observed portion is smaller than an opening of a trapdoor of a burglar. Finally, it is particularly advantageous, if a camera has such an angle of view and is directed to the closure element in a way that the captured image shows a portion of the closure element and the portion not being captured by the camera is smaller than a trapdoor opening of an intruder. If, for example, it is assumed that a potential burglar needs a manhole of at least 40 cm in diameter, so for example a margin of <40 cm of the closure element may remain free of a barcode, a two-dimensional code or an image of a scene, or needs not to be recorded without the risk that an intruder remains undetected. Additionally or alternatively, other areas of <40 cm in diameter may remain free of a pattern or an acquisition by the detection unit or the camera. In this way the region of the closing element to be observed can be reduced, which possibly allows the use of detection units respectively cameras of simpler construction.

Furthermore, it is beneficial, if the detection unit comprises a plurality of sensors, or multiple sensors are arranged on or in a window each being designed to capture mostly overlapping areas, in particular to detect the same capturing area. In this way the fault tolerance of the inventive device can be increased. If, for example, a sensor fails, there is still another for monitoring. Even crawling insects can be masked with the help of this variant of the invention, for example, if alarm is triggered only if several sensors detect an abnormality. Thus, an insect that only covers one sensor still does not trigger an alarm.

It is also favorable, if for each light or dark area a separate sensor is provided, or multiple sensors are arranged in or on a window, each being provided for detecting essentially separate areas. In this way, the evaluation of the signal is very simple. In addition, this variant of the invention is particularly error-tolerant, because an insect can usually cover only one sensor or one light or dark area. With the provision of an appropriate threshold, a false alarm can be avoided easily. Of course, the detection ranges of the sensors can also overlap. In this context it is also pointed out that any combination of this variant of the invention with the aforementioned variant may be advantageous.

It is also advantageous if the pattern reflects in a non-visible wavelength range. Visible patterns can be disruptive to residents under certain circumstances, for example, if they prefer monotone surfaces. In this variant of the invention, however, the pattern reflects in a non-visible wavelength range, for example, in the infrared or ultraviolet wavelength range, and therefore is not disturbing. Also patterns are conceivable that are usually invisible and are only brought to light up by irradiation at a specific wavelength range, i.e. fluorescent patterns.

In another variant of the invention, the pattern is formed by tritium gas light sources. Tritium gas light sources consist of a glass tube, which is coated with a luminescent substance (e.g. phosphorus) on the inside and filled with tritium. Tritium gas light sources can be produced in any shape and shine for several decades without any external energy supply. For example, they can be obtained from the company mb-microtec under the trade name "trigalight". According to the invention, the aforementioned tritium gas light sources are arranged on or in a closure element, for example, by gluing a foil to the closure element, in or on which foil the tritium gas light sources are arranged. Of course, the pattern generated with tritium gas light sources can be combined with a pattern based on a different technology. For example, a printed, glued or painted light-dark pattern can be combined with tritium gas light sources, which for example are embedded in the light or dark areas of the pattern. Accordingly, such a pattern is both visible in bright ambient light (because of the light and dark areas) and in the dark (because of the tritium gas light sources). Advantageously, the pattern needs not to be illuminated in the dark actively, but lights up by itself. If the tritium gas light sources are embedded in the dark areas, the pattern shines as a negative pattern in the darkness. Of course, the light-dark pattern may be completely different from the pattern formed by the tritium gas light sources, so that in bright ambient light a different pattern than in the dark is visible, what makes the manipulation of the inventive arrangement more difficult. The use of tritium gas light sources is not essential for self-illuminating patterns. It is also conceivable to use other technologies, which allow for self-illuminating patterns.

It is particularly advantageous if the detection unit/the camera is provided to be mounted on or behind a transparent pane arranged between the closure element and the detection unit. In this way, the detection unit/the camera is extremely tamper-proof, because trying to manipulate the detection unit requires an offender to gain entry to the building and would thus trigger an alarm in another way. If the detection unit or the camera is mounted on the pane, then the likelihood that people or animals in the interior of the monitored object trigger an unwanted image recording or a false alarm is virtually reduced to zero, as these can freely move inside the object without getting into the observed range of the camera and/or of a sensor of the detection unit. However, the security to detect an intrusion attempt is not affected thereby. This variant of the invention therefore provides a special advantage over alarm systems, which use motion sensors and/or cameras inside the building. Of course, the inventive detection unit can also be arranged in the area between the closure element and a window. For example, it may be positioned at the upper area of the building's opening, in which the closure element and the window are fixed, and be directed downwards.

It is also advantageous if the inventive apparatus comprises means for projecting the pattern onto the closure element. Advantageously, the closure element may remain unchanged, which means it needs not to have any pattern because a pattern can be projected onto the closure element and captured by the detection unit/the camera as needed. Under certain circumstances this may be more convenient for residents, who prefer monotone surfaces. Nevertheless, the usually monotone closure element can be provided with a structure, which may be evaluated by the detection unit/sensor/camera easier than a monochrome surface under certain circumstances. In this case, both one-dimensional and two dimensional codes and images of scenes can be projected, for example by means of LEDs. It is especially decorative when different images are alternately projected onto the closure element, like this known from electronic picture frames for example. On the one hand, this is decorative and varied, on the other hand, the safety of the device is increased by changing the images since the reference pattern intended for comparison with the actual pattern is continuously amended (in sync with the changing images) why a manipulation of the system significantly gets complicated.

It is also advantageous if the inventive apparatus comprises a device to ward off insects. In this way, the risk of a false alarm can be reduced even further. In particular, the mere combination of a detection unit and an insect trap can form the basis for an independent invention.

It is advantageous if the detection unit or a window comprises one or more sensors from the group: camera, multi-zone passive infrared sensor, ultrasonic sensor, radar sensor, laser scanner. Such sensors are proven and reliable means to scan an area.

It is also advantageous if the detection unit comprises means to influence the actual signal and means for checking whether the actual signal detected by (a sensor of) the detection unit or the actual image captured by a camera changes upon activation and/or deactivation of the influencing means and for triggering a fault signal when the result of the check is negative. A "malfunction signal" indicates that the detection unit or the camera is not working properly because a darkening or illumination, for example induced by a source of light, is not recognized.

In this variant, the fact is exploited that the detection unit, the sensor or the camera is directed to the closure element, which in principle is reflective. If now a light source (for example, a LED in the visible or invisible wavelength range) is activated, the emitted light is reflected by the closure element and subsequently collected by the detection unit/sensor/camera. If the detection unit/sensor/camera actually detects a change of the captured image, it works flawlessly. If no change is detected, there is a disturbance, for example, because the detection unit/sensor/camera is dirty or has been tampered. Therefore, a self-diagnosis function for the inventive recording unit, alarm or camera can be realized using this variant of the invention. In principle, the self-diagnosis function can be extended also to the transmission channel (e.g. radio channel) between the detection unit and a central alarm unit if the light source is controlled by the central alarm unit and the captured actual signal or image is evaluated by the central alarm unit too. It is also conceivable that the influencing means are formed by a lever for example, which can be swiveled into the observed area of the detection unit or the image area of the camera by means of a motor.

The light source can emit a continuously varying or pulsed signal, in particular a code or a random number. When the detection unit/the camera is working properly, then it detects a change in the captured signal in sync with the signal transmitted by the light source. If the reflection of the closure element is not sufficient to reasonably establish a self-diagnosis, of course also a suitable reflector, e.g. a cat's eye or a mirror, can be arranged on the closure element.

It is also advantageous if the checking means are provided for checking the strength of the influence and/or the place of the influence and/or the distribution of the influence by the influencing means. In this variant of the invention there is not just a check whether the actual signal captured by the detection unit or the actual image changes on activation and/or deactivation of the influencing means, e.g. a light source, but also in which form the activation and/or deactivation of the light source influences the actual signal detected by the detection unit. For example it may be checked how the signal strength or brightness changes when the influencing means are enabled or disabled. If a deviation from the expected influence occurs during self-diagnosis, then a malfunction signal can be triggered. If an image is captured by the detection unit, it can also be evaluated, at which point of the image a change occurs or should occur. Also, a distribution of the influence in the image can be evaluated. If the change does not occur at the expected location in the captured image or if a different distribution of the change occurs in the captured image, again a function fault signal can be triggered in turn. Advantageously, in this way the security may be increased during self-diagnosis.

It is also particularly advantageous if the closure element comprises a spatial structure or such a structure is attached to this element, in such a way that a signal emitted by the at least one sensor is directed to a receiving point. In this way, light rays, radar waves or sound can be routed to any reception point, especially back to the sensor. Thus, particularly rays or wave fronts slantingly reaching the closure element can advantageously be prevented from being sprinkled what would cause the absence of a processable signal at a reception point. In this context, it is also advantageous if said spatial structure is located on a sticker for a closure element.

It is also favorable if at least one sensor of a detection unit or the detection unit itself is arranged on or in a frame of the window, on or in a muntin cross or window cross of the window, on or in a glazing bead or on or in the pane of the window. In this way, a sensor or a detection unit can be integrated into a component that already exists for another purpose in an elegant way. If a sensor/detection unit is arranged in the space between two glass panes, it is also protected from mechanical damage and dirt. For example, the sensors can be arranged on a window cross, which is located between two glass panes. Moreover, a sensor/detection unit can be located directly on the side of the pane facing said space (for example, glued to it). Advantageously, the glass pane can also serve as a substrate or carrier for conductors that are routed to the sensor/the detection unit. Advantageously, a sensor/a detection unit also can be arranged in a glazing bead of the window. In this way, they are well protected from dirt and mechanical damage. Of course, further elements may be arranged on or in the components of the window, such as light sources, electronic circuits and power sources. The arrangement of an electronic circuit or an electronic component in a component of a window, especially in a glazing bead, can also form the basis of an independent invention.

Advantageously, the window includes a comparison unit for comparing an actual signal detected by the at least one sensor with a reference signal, and means for triggering an alarm signal when the deviation between actual and reference signal exceeds a predetermined threshold. Nevertheless, the comparison unit and the trigger means can also be provided in a remote unit in principle, for example in a device that is placed nearby the window, or even in a central alarm unit. In this case, the sensor signals are transmitted there and just processed there. However, it is convenient to arrange the comparison unit and the trigger means in or on the window so that the sensor signals can be processed locally, thus relieving the central alarm unit.

It is particularly advantageous if the pattern is arranged on a side of the closure element facing the wall. In particular, the pattern is arranged on a surface of the shutter, which faces the guide rails for the roller shutter. In this way, the pattern is visible at no time, even if the shutter is closed. Spying out of the pattern thus is virtually impossible. A sliding or tearing out of the shutter however is reliably detected.

It is also particularly advantageous if the closure element is hollow and comprises a pattern on its inside. In addition to the benefits of the aforementioned embodiment also the advantage is obtained with this variant that cutting open the closure element can be detected because cutting during the day causes light to fall on the sensor, respectively the acquisition of the pattern is disrupted by a blade reaching into the roller shutter.

At this point it is noted that in general variants and resulting benefits disclosed for the arrangement of the invention or the inventive detection unit equally relate to the inventive method, the inventive camera and the inventive window and vice versa.

The above embodiments and modifications of the invention can be combined in any way.

BRIEF DESCRIPTION OF THE DRAWINGS

The present invention is further illustrated by the schematic drawing shown in the Figures of the embodiments. In the drawings.

BEST EMBODIMENTS OF THE INVENTION

Figure 1:
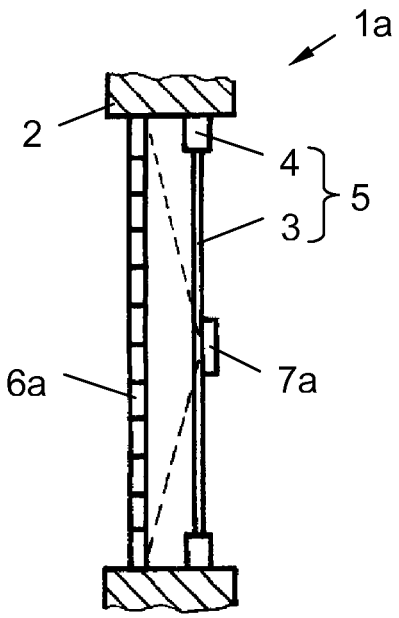
FIG. 1 shows a first variant of an inventive arrangement.

In the Figures of the drawing, identical and similar parts are denoted with the same reference numerals and functionally similar elements and features—if nothing else is declared—are denoted with the same reference characters, and where appropriate with different indices.

FIG. 1 shows a first variant of an inventive arrangement 1*a*. In a wall 2 of a building an opening is arranged. In this opening a pane 3 is provided. In particular, the pane 3 is placed in a frame 4 and together with this forms a window 5. The pane 3 may be made of glass, plastic or composite material. Furthermore, the arrangement 1*a* comprises a closure element 6*a* (especially a non-completely transparent closure element 6*a*) arranged in said opening at the building's outside in relation to the window 5 and a detection unit 7*a* arranged at the building's inside in relation to the window 5 or a sensor on the building's inside.

Figure 2:
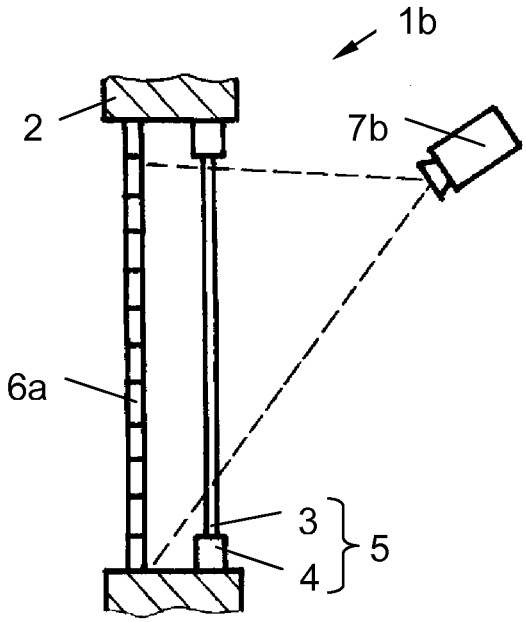
FIG. 2 shows a second variant of an inventive arrangement.

FIG. 2 shows an alternative embodiment of the invention in the form of an arrangement 1*b*, which is very similar to the arrangement 1*a* of FIG. 1. By contrast, the detection unit 7*b* is not located on the pane 3 but something behind it inside of the building. The detection unit 7*b* may be designed as a camera for example.

Both the arrangement 1*a* as well as the arrangement 1*b* include a comparison unit (not shown) to compare an actual signal captured by the detection unit 7*a*, 7*b* with a reference signal, and means for triggering an alarm if the deviation between the actual signal and reference signal exceeds a predetermined threshold. The comparison unit and the means for triggering an alarm can be integrated in the detection unit 7*a*, 7*b*, which then fulfills the function of an alarm sensor. The aforementioned components may also exist as a separate entity. Furthermore, it is also possible that the comparison unit is arranged at a place remote from the window 5.

If the detection unit 7*a*, 7*b* includes a camera or is it formed by it, then the comparison unit can be designed for comparing an actual image captured by the camera 5 with a reference picture. Furthermore, it may comprise means for triggering an alarm and/or image recording by the camera when the deviation between the actual image and the reference image exceeds a predetermined threshold. In the following discussion, the actual signal may therefore also interpreted as the actual image and the reference signal as the reference image.

In the arrangement 1*a* according to FIG. 1, the actual signal captured by the detection unit 7*a* advantageously cannot be influenced by the residents of the monitored object, which move behind detection unit 7*a*. The probability of a false alarm of the arrangement 1*a* therefore is extremely low, as actually only the space between the shutter 6*a* and the window 5 is monitored. Persons inside the building and persons outside of the building, which are only staying in the vicinity of the same but do not mean mischief, do not trigger an (false) alarm.

In the FIGS. 1 and 2, the detection units 7*a*, 7*b* are directed to the shutter 6*a* such that the captured image exclusively shows the shutter 6*a*. Of course, the captured area can be bigger, but substantially should be limited to the shutter 6*a*. The captured area can also be smaller, as will be explained in the FIGS. 17 and 18 in more detail. Again, this is a reason why it is unlikely that people inside the building cause a false alarm even when using the configuration 1*b*, because the inside area captured by the detection unit 7*b* is comparatively small.

In the shown examples a shutter is provided as a closure element 6*a*. This can be built in a conventional form, be motorized or manually operated, and can be made of plastic, metal or another material. If the shutter 6*a* is moved, cut out or torn from its anchorage, then this is detected by the detection unit 7*a*, 7*b* and an intruder alarm is triggered.

Figure 3:
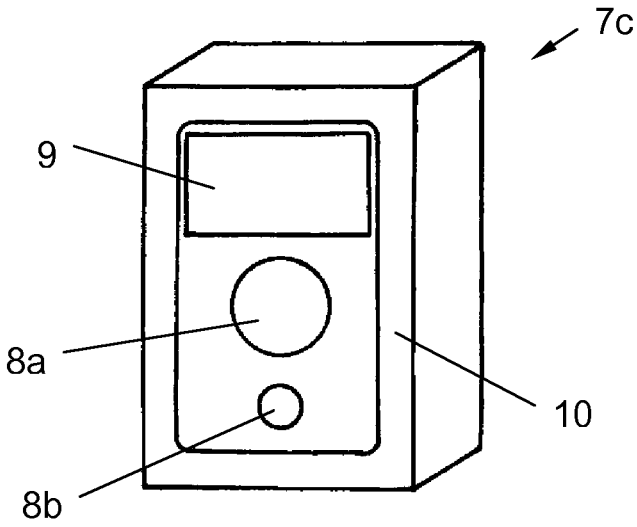
FIG. 3 shows a first variant of an inventive detection unit.

FIG. 3 shows a variant of a detection unit 7*c*, which (like the detection unit 7*a*) is prepared for mounting on a pane 3 of a window 5, in an oblique view. The detection unit 7*c* includes a sensor 8*a* in the form of a camera with a lens (i.e. a collection of more light-sensitive elements, here for the visible wavelength range), a passive infrared sensor (PIR sensor) 8*b*, and a solar cell 9, which is provided for energy supply of the detection unit 7*c*. Since the detection unit 7*c* is arranged on a pane 3 of the window 5, incident light can be converted into electrical energy for the detection unit 7*c* during the day, when the shutter 6*a* is open. In this example, the PIR sensor 8*b* is used to capture a person in the detection range of the camera 8*a* and to subsequently trigger an alarm and/or to start recording an image then, to document a sequence of events. Of course, the PIR sensor 8*b* can also be omitted if the detection unit 7*c* (the alarm sensor 7*c*) comprises means for comparing an actual image captured by the camera 8*a* with a reference image. If a substantial difference between the actual image and the reference image is detected, an alarm is triggered and/or an image recording is started. In this way, valuable evidence can be collected. For example, the offender, after he gained access through the shutter 6*a*, can be filmed through the pane 3 while manipulating the (still closed) window 5. This applies also to the detection unit 7*b* of FIG. 2.

In addition, the detection unit 7*c* includes an adhesive surface 10, with which help the detection unit 7*c* can be directly mounted on the pane 3 of the window 5. Of course, other variants of the detection unit 7*c* can be housed in a casing with an adhesive surface 10. The variant shown with a PIR sensor 8*b* and a solar cell 9 therefore—although it is advantageous—is to be seen just illustrative. The adhesive surface 10 may also be disposed on the backside to mount the detection unit 7*c* on the outside of the window 5, for example, again on the pane 3 or on the frame of the window 5. In principle, it can also be attached to the building opening itself.

Figure 4:
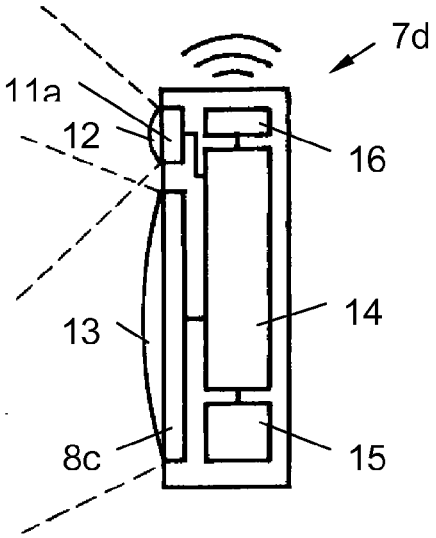
FIG. 4 shows a second variant of an inventive detection unit.

FIG. 4 shows a block diagram of an exemplary detection unit 7*d*. This includes a light source 11*a*, for example, a lamp or a light emitting diode, which emits light through a lens 12, especially onto the closure element 6*a*. Furthermore, the received light, for example reflected by the closure element 6*a* falls through a collimating lens 13 onto a light sensitive sensor 8*c*, for example a CCD line sensor (Charge Coupled Device), a CMOS sensor (Complementary Metal Oxide Semiconductor) or equivalent, and is recorded by it. A central control unit 14 on the one hand controls to the light source 11*a*, for example, time scheduled, and on the other hand receives the signal detected by the sensor 8*c*. For example, it can be used to switch the light source 11*a* on and off controlled by brightness. Finally, the light source 11*a* can also be turned on and off manually or by the closure element 6*a* (for example, the light source 11*a* is switched on when the shutter 6*a* is closed). If there is enough ambient light, then the light source 11*a* can be turned off when the sensor 8*c* provides a reliable signal anyway.

The control unit 14 now receives the actual signal captured by the sensor 8*c* (respectively an actual image) and compares it with a reference signal (respectively a reference image) stored in a memory 15. If the deviation between actual signal and reference signal exceeds a predetermined threshold, then an alarm is triggered. For this purpose, the detection unit 7*d* includes a radio interface 16, through which a message is sent to a central reporting unit of an alarm system. Of course, the alarming may also be done wire-bound. In another variant, also images, which document a sequence of events, are sent to a remote storage medium over the radio interface 16 or by wire in order to thwart criminal's access to evidence.

If the actual image captured by the detection unit 7*d* Includes a pattern (see also FIGS. 6 to 12 and 32 to 35), such as a barcode or a two-dimensional code, the control unit 14 can also receive the actual pattern M captured by the sensor 8*c* and compare it with a reference pattern stored in a memory 15. This can be done pixel by pixel or also in coded form. A bar pattern or a two-dimensional pattern can be associated with a certain number or a specific symbol, on which basis the comparison takes place. In this case, also a reference code can be stored in the memory 15. The advantage of processing the actual pattern and the reference pattern in encoded form, i.e. in the form of symbols, is that it requires relatively little computing power and memory requirements. If the difference between the actual pattern M and the reference pattern respectively between the actual symbol and the reference symbol exceeds a predetermined threshold, then an alarm is triggered.

In an advantageous variant of the invention, the comparison is performed only periodically, e.g. every 60 seconds. In-between the detection unit 7*d* is switched to an idle mode (especially the light source 11*a* is turned off) in order to save power. It is also conceivable that the detection unit 7*d* comprises a solar cell (see also FIG. 3) for power supply. Since the detection unit 7*d* usually is arranged on or near the pane 3, incident light can be converted into electrical energy for the detection unit 7*d* during the day, when the shutter is open 6*a* as has been mentioned before.

In this example the lenses 12 and 13 of the detection unit 7*d* are configured such that a relatively wide range can be scanned respectively illuminated. Of course, also smaller detection areas respectively lighting areas may be provided, especially when multiple detection units 7*d* are arranged along the roller shutter 6*a* (see also FIGS. 10 to 12). Instead of simple lenses 12 and 13 of course more complex optical systems are imaginable. In particular, the use of collimators is conceivable.

Figure 5:
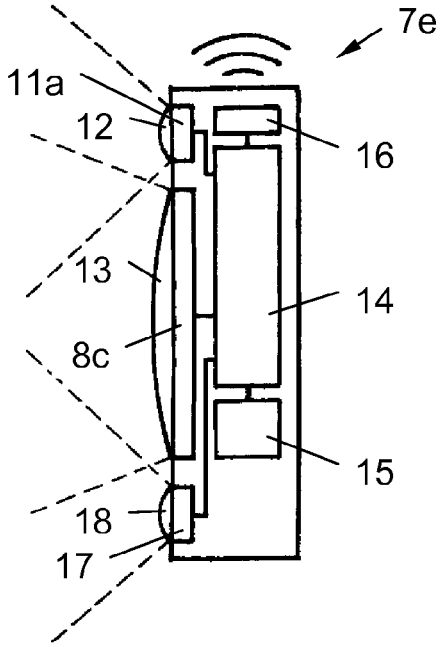
FIG. 5 shows a third variant of an inventive detection unit.

FIG. 5 now shows an alternative embodiment of an inventive detection unit 7*e*, which is very similar to the detection unit 7*d* presented in FIG. 4. In this example, an infrared sensor is provided as a sensor 8*c*. Additionally, the apparatus 7*e* comprises a camera 17 with an accessory lens 18.

In a first operating mode, the camera 17 is merely used for recording of images due to an intruder alarm or a malfunction alarm respectively a tamper alarm. This is initiated by the sensor 8*c* in the manner already mentioned before. Of course, the alarm may also be reported to a central reporting unit of an alarm system.

In a second operating mode both the infrared sensor 8*c* and the camera 17 are used to detect an intrusion attempt or a manipulation attempt. In this case, monitoring advantageously is done in different wavelength ranges, why an intrusion attempt or a manipulation attempt can be detected in a much more differentiated way. The detection unit 7*e* thus can be designed more fault-tolerant, for example, if alarm is triggered only when both the infrared sensor 8*c* and the camera 17 report an anomaly. Conversely, the security can be enhanced if an alarm is already triggered when either the infrared sensor 8*c* or the camera 17 detect an anomaly. Of course, the camera 17 can be used to produce images from a sequence of events as mentioned above.

Shutters 6*a* as well as other closure elements often have only a slightly contrasting structure. A roller shutter 6*a* mostly is single-coloured, for example, white or brown, and thus forms a monochromatic plane in the closed state. To detect a change or a movement of the shutter 6*a* better and thus to detect an intrusion attempt with higher safety, the shutter 6*a* can now be provided with a pattern. This pattern can be projected onto the roller shutter 6*a* in a first embodiment or be mounted directly thereon or integrated therein in another embodiment.

Figure 6:
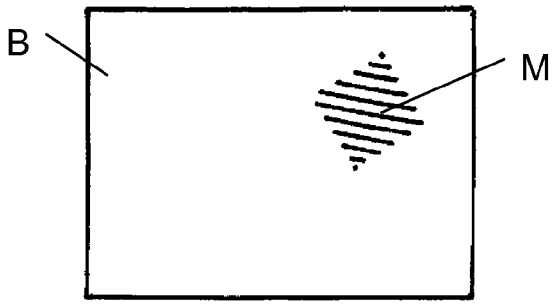
FIG. 6 shows an exemplary image captured by a detection unit with a superimposed pattern.

For the first embodiment, FIG. 6 shows an exemplary image B captured by the detection unit 7*d*, 7*e*, in which image a pattern M generated by a light source 11*a* can be seen. In this example, a bar pattern M is visible, which is bounded by a square standing on its corner. The pattern M can be seen in the upper right image area. Of course, a pattern M in the form of parallel lines is not mandatory. Of course, other patterns M are possible. For example, various geometric shapes such as circles, rings, polygons, and the like as well as complex patterns M can be projected. These patterns M are preferably produced by special shapes of the lens 12.

If the manufacturer of the detection unit 7*d*, 7*e* provides several different lenses 12, an individual and more or less random pattern M may be provided for each detection unit 7*d*, 7*e* if the lens 12 itself as well as its assembly direction is varied (in our case the stripes may be oriented differently by rotating the lens 12). If the shutter 6*a* is moved up or destroyed, this pattern M at least partially is emitted into free space i.e. is no longer reflected by the shutter 6*a* and thus can no longer be detected by the detection unit 7*d*, 7*e*. The pattern M can be generated continuously or periodically recurring (in equal or varying, especially random intervals) by the light source 11*a*.

In the above example it is assumed that the light emitted by the light source 11*a* is reflected by the shutter 6*a*. Usually, shutters 6*a*, in particular white shutters 6*a*, have a sufficient reflectivity. Of course, reflectors, such as mirrors, cat's eyes, reflective films (especially self-adhesive) and the like can be provided on the shutter 6*a*.

Generally, the strength of the influence of the light source 11*a* (i.e. essentially the contrast of the pattern M) and/or place of the influence (i.e. the test whether the pattern M appears in the upper right area in the shown example) and/or the distribution of the influence (i.e. the test whether a bar pattern with square boundary is visible) can be evaluated. The pattern M can be emitted in the visible wavelength range as well as in the invisible wavelengths. The latter is particularly advantageous, as a potential burglar cannot see that a pattern M is emitted or how this looks like.

Figure 11:
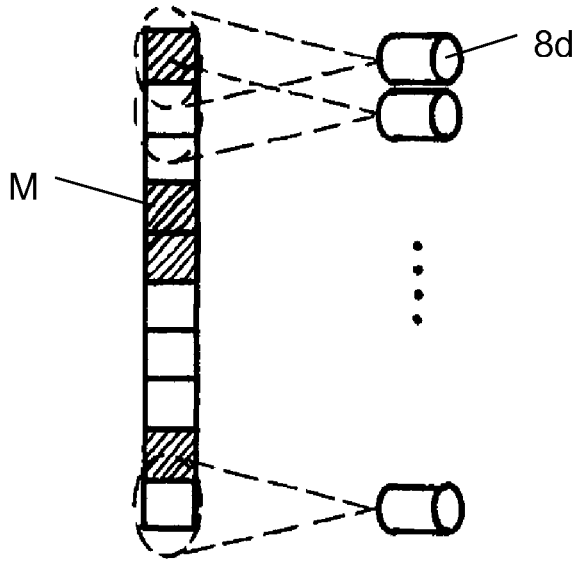
FIG. 11 shows an arrangement of multiple sensors with little overlapping detection ranges.
Figure 12:
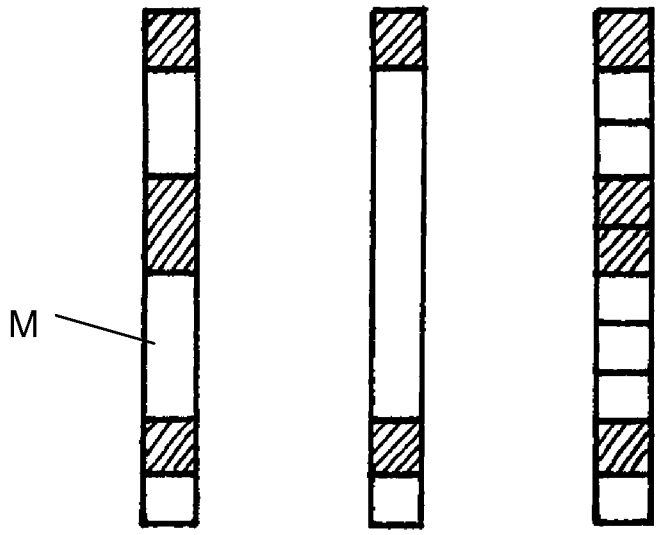
FIG. 12 shows a method for segmentation of patterns.

Generally, the inventive detection unit 7*d*, 7*e* also may include multiple sensors 8*c* and/or more light sources 11*a* to reduce susceptibility (see also FIGS. 11 and 12). For example, the provision may be done that alarm is only triggered when 2 of 2 sensors 8*c* detect an abnormality, for example to avoid a false alarm caused by insects that crawl on the detection unit 7*d*, 7*e*. For the same reasons, a plurality of light sources 11*a* can be provided. In addition, various light sources 11*a* can also cause different patterns M and thus different influences of the signal captured by sensor 8*c*, such as for example by generating random patterns M, retrieving a random pattern M from a set of predefined patterns M or by sequentially retrieving predefined patterns M (for example stored in a table). By alternately, in particular random triggering of different light sources 11*a*, the inventive detection unit 7*d*, 7*e* can be protected against unwanted manipulation even better. It is also advantageous if the sensor 8*c* is mounted at a different position than the light source 11*a* and/or is aligned in a different direction to further complicate a manipulation of the detection unit 7*d*, 7*e*.

In another embodiment, an intruder alarm is differentiated from a malfunction alarm respectively from a manipulation alarm. In this way, a self-diagnosis function of the detection unit 7*d*, 7*e* can be realized.

For this reason, the central control unit 14 switches the light source 11*a* from an on-state to an off-state or from an off-state to an on-state. Now it is checked whether the actual image captured by the sensor 8*c* changes upon activation and/or deactivation of the light source 11*a*, especially beyond a threshold value (if the light source 11*a* is turned on, then the signal detected by the sensor 8*c* gets stronger or the acquired picture gets brighter, or, for example, the pattern M shown in FIG. 6 appears in the captured image. Similarly, the image changes when the light source 11*a* is turned off). If the actual signal respectively the actual image changes in the expected way, then everything is fine. If this is not true, then a malfunction signal respectively a manipulation signal is triggered because the light source 11*a*, the sensor 8*c* or the evaluation circuit is damaged or tampered by a potential burglar. In this way a PIR sensor or a camera can be prevented from being made inoperable unnoticed by simply spraying or taping, and the inhabitants of the object secured by an alarm system can be prevented from imagining the false sense of security, for example, if the PIR sensor or camera is manipulated when the alarm is disabled (e.g. during the day).

The intrusion alarm and tamper alarm basically can be signalled in the same way, however, in an advantageous variant of the invention the intruder alarm and tamper alarm are signalled in a different way. In this way, the operator of the alarm system can be informed about the state of the same in a very differentiated manner.

Of course, the activation pattern of the light source 11*a* can reach from simple on/off-switching, over periodically pulsing of the same, up to the emission of complex codes or binary patterns. In particular, also random numbers can be sent out to complicate a manipulation of the detection unit 7*d*, 7*e*. The following table shall even better illustrate how this variant of the invention works. Here the symbol "Ø" indicates that no change of a state occurs, and the symbol "↑↓" indicates that a state change occurs.

| | | | | |
|---|---|---|---|---|
| light source | Ø | ↑↓ | Ø | ↑↓ |
| sensor | Ø | Ø | ↑↓ | ↑↓ |
| action | Ø | manipulation | intrusion | Ø |

If the state of the light source 11*a* is not changed (i.e. if it is neither enabled nor disabled) and if the sensor 8*c* also detects no change of state, then no action is taken. If the state of the light source 11*a* is changed and the sensor 8*c* again detects no change of state, then a malfunction alarm respectively a tamper alarm is triggered. If the state of the light source 11*a* is not changed and the sensor 8*c* detects a change in state anyway, then an intrusion alarm is triggered. If the state of the light source 11*a* is changed and the sensor 8*c* also detects an expected change of state, then no action is performed (of course, alternatively it may also be confirmed that the detection unit 7*d*, 7*e* operates properly, for example, with a green indicator light).

As already mentioned, the inspection can be evaluated with regard to the strength of the influence and/or the place of the influence and/or the distribution of the influence caused by the light source 11*a*.

Advantageously, the self-diagnosis is carried out periodically recurring, for example every 10 minutes. Of course, shorter or longer intervals are possible, such as once a day. As a manipulation attempt is already difficult to impossible when the alarm system is armed, the self-diagnosis can be activated when arming the alarm system for example. Finally, it is also conceivable that the self-diagnosis is activated in certain lighting conditions, for example when it gets dusky. This is particularly advantageous if the strength of influence and/or the place of influence and/or the distribution of influence caused by the light source 11*a* is evaluated. In this way, always essentially the same lighting conditions occur during the self-diagnosis. If the self-diagnosis is done relatively rare, the probability that a potential intruder gets knowledge about the mode of the self-diagnosis, moreover is extremely low or involves a high expenditure of time for a potential offender.

If a camera is provided as sensor 8*c*, then of course it cannot only be used to regularly make pictures of the sequence of events if an intruder alarm is triggered, but also if a malfunction alarm or tamper alarm is triggered.

Instead of or in addition to the light source 11 also motor-driven moving levers, disks or the like can be provided as influencing means. If, for example, a disk with one or more holes is provided, which permit the view of the sensor 8*c* or not, a self-diagnosis can also be performed by purposefully rotating the disc. Advantageously, such a disk can also be used as a defense against insects, as the disk is moved before a detection by the sensor 8*c* and in this way insects, which obstruct the view of the sensor 8*c*, are chased away. Moreover, the disk can serve as a lens protection so as to prevent soiling of the optical systems of the detection unit 7*a* . . . 7*e*. Instead of the aforementioned disc also other means may be used for said purposes, for example, slides, levers and the like, which can be moved by rotary motors and linear motors.

Figure 7:
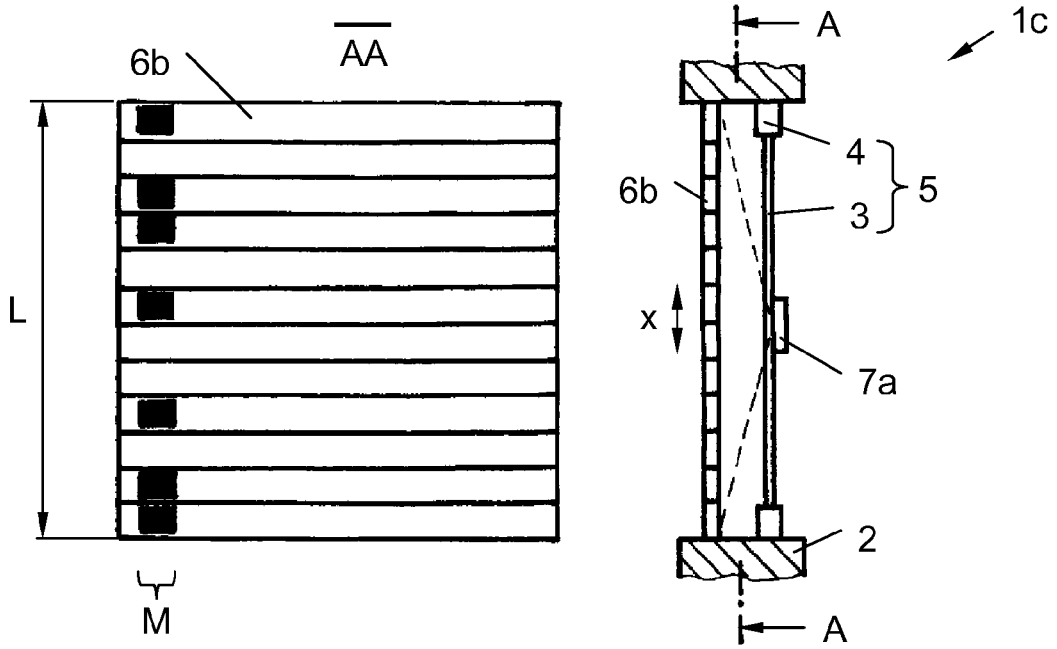
FIG. 7 shows a first example of a pattern attached to rolling shutter in the form of an one-dimensional code.
Figure 8:
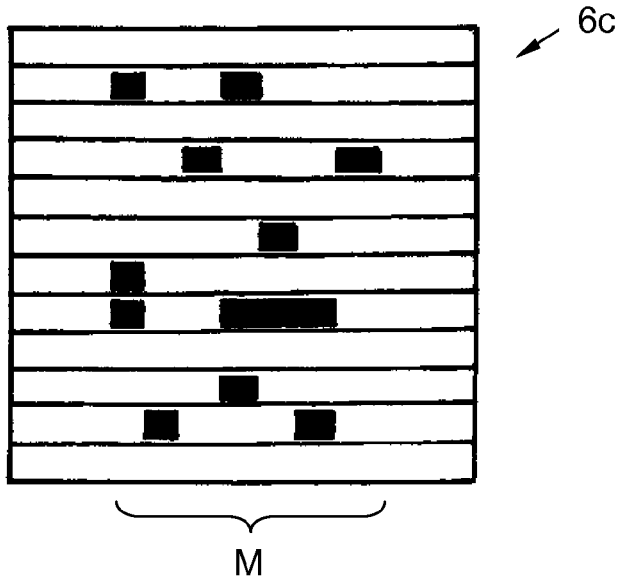
FIG. 8 shows a second example of a pattern attached to rolling shutter in the form of a two-dimensional code.
Figure 9:
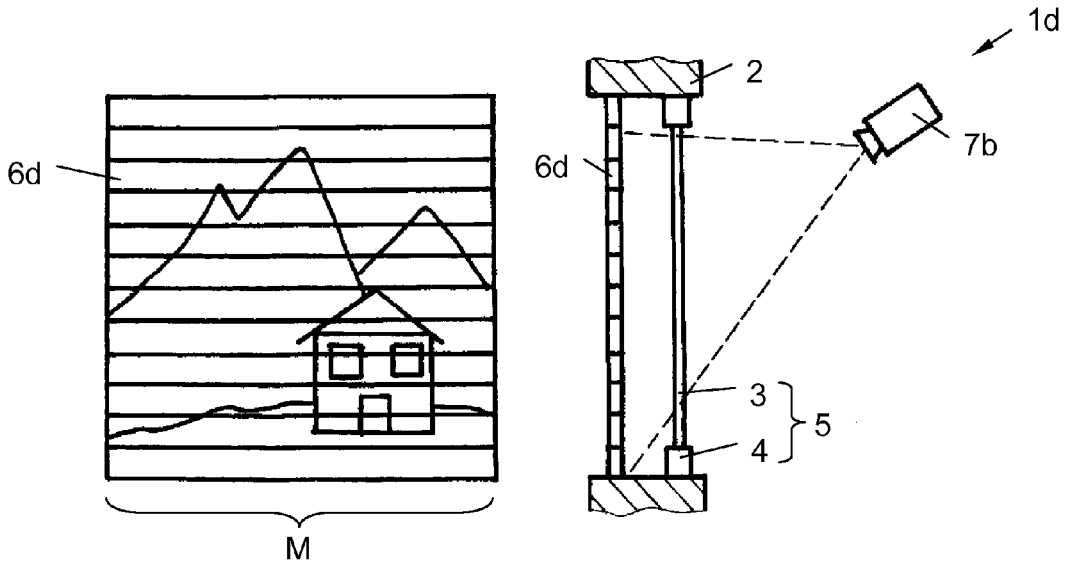
FIG. 9 shows a third example of a pattern attached to rolling shutter in which an image of a scene is used.

FIGS. 7-9 now show further variations of the invention, wherein a pattern M is directly attached to a roller shutter 6*b* . . . 6*d* or is integrated into this.

FIG. 7 schematically shows an arrangement 1*c* (sectional view and view AA), which is very similar to the arrangement 1*a* shown in FIG. 1. A building's opening in a wall 2 is closed by a closure element 6*b*, which is non-completely transparent, for example, again with a roller shutter 6*b* respectively exterior blinds or so-called "raffstore blinds". Furthermore, the building's opening is closed with a window 5, which is arranged behind the shutter 6*b* and comprises a window frame 4 and a transparent pane 3.

A pattern M is arranged on the shutter 6*b* on the side facing the interior of the building, in the example shown in the form of a bar code. A detection unit 7*a* is arranged on the pane 3 on the side facing the interior of the building, which detection unit 7*a* captures the bar code M on the shutter 6*b*. A comparison unit now compares the pattern M detected by the detection unit 7*a* with a reference pattern and triggers an alarm if the deviation between the actual pattern M and the reference pattern exceeds a predetermined threshold. For example, the reference pattern can be saved during production of detection unit 7*a* or during the installation of the inventive device.

If the shutter 6*b* now is moved without authorization, then this will inevitably lead to a change of the pattern M detected by the detection unit 7*a*, since said pattern M is shifted in relation to the detection unit 7*a*. Likewise, cutting out or tearing out of the lamellas of the shutter 6*b* also leads to a modification of the pattern M. In the night a bright area becomes a dark area because of said tearing out, during day a dark area becomes a bright area. Preferably, such a threshold for an allowable deviation of the actual pattern M from the reference pattern is provided that insects that reside in the space between the shutter 6*b* and the pane 3 do not trigger a false alarm.

When comparing the actual image B with a reference image, the pattern M can be used as such. For example, the pattern M is captured in the form of an image having several lines and compared with a reference image. Alternatively or additionally, also a code based on the pattern M can be used to do so. For example, the sequence of light and dark elements can be interpreted as a binary number or symbol. In this case, this binary number is simply compared with a reference number. Preferably the Gray code is used therefor, wherein adjacent numbers are characterized by only one changed bit. Thus, the deviation +/−1 from a reference value can be allowed as an acceptable threshold for example. A false alarm due to an insect covering a bright field of the pattern M can be reliably prevented in this way.

Preferably, the pattern M extends essentially over entire length L of the shutter 6*b* seen in a direction of its movement x. In this way, the removal of any lamella can be detected. Since thieves make a manhole usually only in a desired area, the pattern M can also be arranged only in that area. For example, it is unlikely or impossible for thieves to remove only a few lamellas in order to gain an access to the building. Therefore, the pattern M can be limited to a central area of the shutter 6*b* for example. Advantageously, just a smaller detection area is necessary for the detecting element 7*a* then (see also the FIGS. 17 and 18). This may be constructed simpler therefore.

FIG. 8 now shows a further embodiment of the invention, where a two-dimensional code is used instead of an one-dimensional bar code. Advantageously, a larger area of a shutter 6*c* is monitored here, so that an unnoticed making of a manhole is even more difficult. In this variant, the detection unit 7*a* is designed to detect a two-dimensional pattern M. The comparison of the actual pattern M with a reference pattern again can be made in uncoded or coded form.

In a further preferred embodiment of the invention the bar code shown in FIG. 7 can also be provided over the entire width of the shutter 6*c* or in a central area of the same. For example, the shutter 6*c* is scanned by the detection unit 7*a* in several vertical stripes or columns then. In this case, the reference pattern is the same for each strip. For example, an alarm will be triggered if a deviation of the detected actual pattern M from the reference pattern occurs in at least two stripes.

In general, the pattern M can be painted, be printed or applied with a foil for example. For example, individual pieces of a reflective/bright and/or absorbing/scattering/dark foil can be stuck on the lamellas of the shutter 6*b*, 6*c*. It is also conceivable that a vertical strip is stuck to the shutter 6*b*, 6*c* and then divided with a sharp knife, so that a proper mechanical function of the shutter 6*b*, 6*c* is guaranteed. It is also conceivable, not to cut up the stripes so that the light holes, which are formed between the lamellas when a shutter 6*b*, 6*c* is slightly opened, remain covered and in this way the detection unit 7*a* is protected against extraneous light. The invention may be applied on existing shutters 6*b*, 6*c* very easily in the mentioned way.

At this point it is noted that in the present examples the pattern M was mounted the grid of the lamellas of the shutter 6*b*, 6*c*. However, this is advantageous but not mandatory. The bright and/or dark areas can of course also be applied over the borders of the lamellas.

Instead of a technical and abstract pattern M also an image of a scene can be applied. In this context, FIG. 9 shows a further inventive arrangement 1*d*, which is very similar to the arrangement 1*b* shown in FIG. 2, wherein an image of a scene is provided as a pattern M. In the present example, an image of a house in the foreground of a mountain landscape is arranged on the shutter 6*d*. Although landscape scenes are very good for the inside of a roller shutter 6*d*, of course any other motif can be used, for example, portraits, pictures of animals, etc.

In this example, the detection unit 7*b*, which is especially designed as a camera, again is arranged somewhat behind the pane 3 in the ceiling area of the interior or on an inner wall opposite of the pane 3. Of course, the detection unit 7*b* can also be arranged directly on the pane 3, if an adequate wide-angle lens or a fish eye is used. In this example, the comparison unit compares the actual image with a stored reference image.

Of course, the present arrangement 1*d* with a detection unit 7*b* displaced backwards also can be used to capture bar codes and two-dimensional codes. In particular, a camera arranged in the detection unit 7*b* may evaluate the code by means of the function known from mobile phones ("mobile scanner").

The variant shown in FIG. 9 is ideal for decorating interiors, for example, by printing any photo or design on a paper sheet or an adhesive foil to attach it to the shutter 6*d* then. A web-based system—similar to the familiar interface of photo labs—which allows uploading of any photos by the user can be imagined here. These photos are then used by the provider of the alarm system to make the mentioned foils or to print them on the lamellas of the shutter 6*d* ("customizing"). Of course color images, grayscale images and pure black and white images with photo-realistic representations to any alienation are conceivable.

However, applying black and white codes or images may also be undesirable, for example if the user prefers a monotone colored area. In this case, a pattern M reflecting the in a non-visible wavelength range can be provided. For example, bar codes are known, which are applied with special colors and then reflect in the ultraviolet range. In this way, a bar code, a two-dimensional code or an image just being visible under illumination with a ultraviolet lamp may be attached to the shutter 6*b* . . . 6*d*. In this way, very subtle patterns M and patterns M more or less invisible for the human eye are feasible. With an adequate strong illumination also decorative lighting effects can be achieved, for example, if an image attached to shutter 6*b* . . . 6*d* lights up in the light of an ultraviolet lamp. Of course, also a pattern M reflective in the infrared range or a fluorescent pattern M can be used equivalently.

In another variant of the invention, the pattern M is formed respectively supplemented by tritium gas light sources, which are arranged on or in a closure element 6*b* . . . 6*d*. The tritium gas light sources can be embedded in the light or dark areas of the pattern M, so this is visible both day and night. Beneficially, the pattern M needs not to be illuminated actively in the dark then, but lights up by itself. Of course, the light-dark pattern may also be completely different from the pattern M formed by the tritium gas light sources, so that in bright ambient light a different pattern M is visible than in the dark, which makes the manipulation of the inventive arrangement even more complicated. The use of tritium gas light sources is not essential for self-luminous patterns M. It is also conceivable to use other technologies.

Advantageously, a manipulation of the alarm device is almost impossible due of the use of a pattern M, because this would require a potential perpetrator to know the design of the pattern M. However, this is neither visible for the offender in the closed state of the shutter 6*b* . . . 6*d* (the pattern M is visible only from inside of the building) nor in the open state (the pattern M is invisible in the shutter box). Even when using rolling doors, fabric roller blinds, blinds and raffstore blinds, the pattern M is not visible in the open state of the respective closure element.

In the previous examples, the light source 11 can be used to illuminate the pattern M captured by the sensor 8*c*. The light source 11 can illuminate it permanently, or can be activated only at certain times to save power. The light source 11 can also be switched off if the ambient light is sufficient to ensure that the sensor 8*c* can reliably capture the pattern M anyway.

The variants of the invention shown in the FIGS. 7-9 particularly can be combined with the variant shown in FIG. 6, i.e. combined with a pattern M projected onto the shutter 6*b* . . . 6*d*. In particular, the light source 11*a* may be used then for a self-diagnostic function of the detection unit 7*b* . . . 7*d*.

Alternatively or in addition to the above mentioned variants of a detection unit 7*a* . . . 7*d* also a laser scanner can be used. In this case, a beam is deflected single- or two-dimensionally by a movable mirror, and the brightness of the reflected light is determined. Advantageously, the sampled area can be adjusted very well by use of a laser scanner. Of course, multiple laser scanners may be provided. However, in principle laser scanners can also be used to generate a pattern M, which is then detected, for example, by a camera and evaluated in the manner already described.

The inventive teaching is equally applicable to, for example, acoustic sensors (ultrasonic sensors) and radar sensors. If, for example, an ultrasonic sensor is used, then an acoustic signal is emitted and the reflected sound is evaluated. Here, an "acoustic" image of the surface of the shutter 6*a* . . . 6*d* can be captured in a way which is known per se. In this sense, also a sequence of events can be documented by capturing such images. Of course, the teaching related to the self-diagnosis function from FIG. 6 and the pattern M from FIGS. 7 to 9 can be applied to an ultrasonic sensor. When using the self-diagnosis function, a special acoustic signal is emitted instead of a special optical signal. The pattern M is achieved by different reflective properties of the shutter 6*a* . . . 6*d* in the acoustic range. For example, "dark" areas can be achieved by scattering sound in these areas, which is not reflected to the transmitter then. For this purpose, for example, a pyramid-shaped structure (as it is known in principle from sound-absorbing rooms) can be provided. For the realization of a pattern M also the applying of depressions in the form of blind holes is possible. Advantageously, the shutter 6*a* . . . 6*d* may be designed plain-coloured when using an ultrasonic sensor or radar sensor.

In a preferred variant the unauthorized movement of the shutter 6*a* . . . 6*d* or the destruction of the same just triggers a silent alarm. In this way the police can be alerted and may be arrest the burglar before he can get access to the building through the window (which advantageously is also secured). Advantageously, only the unauthorized opening of the window 5 or the destruction of the same triggers a widely perceptible alert to hold off the burglars from getting into the building. Of course, even the unauthorized opening or destroying of the shutter 6*a* . . . 6*d* can activate an outdoor siren. Thus, the invention may help to ensure that potential offenders are arrested even before they ever get into the building. Unfortunately, experience shows that sensors on windows 5 provide just weak protection. Indeed these trigger an alarm, but the windows 5 are already broken in this case, and the offender has just a low inhibition threshold to actually enter the building then. In general, a few minutes are sufficient for him to do his deed. This is usually shorter than the time it takes for the police to arrive on the scene.

Compared to conventional systems (outside-mounted motion sensors, photoelectric sensors, safety shut-off mats, etc.), the inventive device has the significant advantage that, for example, animals or even people who are approaching the building, but commit no crime, do not trigger an alarm. Advantageously, only the unauthorized opening or breaking of a shutter 6*a* . . . 6*d*, which undoubtedly represents an intrusion attempt, leads to an alarm.

The invention has been described only on the basis of a completely closed shutter 6*a* . . . 6*d*. Of course, also the monitoring in the partially open state is possible. In this case, a reference signal/reference pattern is captured when the shutter 6*a* . . . 6*d* is partially open and then used for the comparison with an actual signal/actual as mentioned before. A further opening (or closing) respectively a tearing out of the shutter 6*a* . . . 6*d* is detected similarly as previously described. The detection of a reference signal/reference pattern can be controlled manually, for example by performing a special function for detecting a reference signal/reference pattern in a detection unit 7*a*, 7*b*. It is also conceivable that a central alarm unit instructs all detection units 7*a*, 7*b* connected to said central alarm unit (via wire or wireless) to run such a function. Then the shutters 6*a* . . . 6*d* are monitored with respect to a change of their position being present at the time of capturing the reference signal. Similarly, a shutter 6*a* . . . 6*d* can also be monitored with tilted window 5. The function for capturing the reference signal, for example, can be controlled by time or brightness or can automatically be performed when the alarming device is armed.

In an advantageous variant, the reference signal/reference pattern captured with partially open shutter 6*a* . . . 6*d* is checked for plausibility, because this actually corresponds to a portion of the reference signal/reference pattern of the closed shutter 6*a* . . . 6*d*, which has been shifted upwards. If this is not the case, a disturbance of the detection unit 7*a*, 7*b* may be signaled.

To avoid a false alarm caused by people or animals, which pass by the partially opened shutter 6*a* . . . 6*d* outside of the building, the detection can be further limited to the area covered by the shutter 6*a* . . . 6*d*. Changes outside this area will be ignored or valued less than the changes in area covered by the shutter 6*a* . . . 6*d* for the triggering of an alarm.

Advantageously, the pattern M comprises more bright and dark areas than there are sensors. In this way, the reference pattern currently being valid can simply be changed by intentional partial closing of the shutter 6*b* . . . 6*d* so as to further complicate manipulations by a potential intruder. For this purpose, it is also conceivable that an electrically operated roller shutter 6*b* . . . 6*d* moves into a random end position when closing. A potential intruder would therefore have to spy out a variety of patterns M for manipulating the alarming device.

In another variant of the invention, the triggering of an alarm is stopped when the handle of the window 5 is moved to an open position. In this way, an accidental triggering of an alarm by the residents of the secured object can be avoided. Here, the alarming can be prevented locally if the transmission of an alarm message to a central alarm unit is suppressed, or a message is sent it to said central alarm unit to ignore an alarm from said shutter 6*b* . . . 6*d*.

Figure 10:
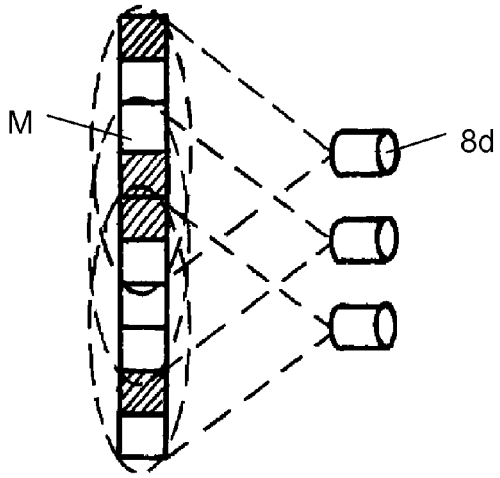
FIG. 10 shows an arrangement of multiple sensors with highly overlapping detection ranges.

FIG. 10 now shows a variant of the invention, wherein the detection unit 7*d*, 7*e* comprises several sensors 8*d*, here three sensors 8*d*, which monitor widely overlapping areas. Only if two sensors 8*d* detect an anomaly, an alarm is triggered. Advantageously, for example insects crawling in the range of a sensor 8*d* on the pane 3 do not trigger an alarm. Therefore, this variant of the invention is extremely fail-safe. Of course, the presented principle may be extended to two or more than three sensors 8*d*. For example, it may be provided that an alarm is just triggered when 1 of 2, 3 of 3, 2-4 of 4, etc. sensors 8*d* detect an abnormality. Also, the detection unit 7*d*, 7*e* can comprise one or more light sources 11*a* (not shown).

FIG. 11 shows a variant of the invention, wherein the detection unit 7*d*, 7*e* again comprises several sensors 8*d*, which by contrast monitor essentially separate areas. For example, any light or dark area (i.e. each "bit") can be associated with a separate sensor 8*d*. The evaluation of the captured pattern M thus is particularly simple. The sensors 8*d* can, for example be designed as photodiodes, light-sensitive resistors or photo-transistors. These components are cheaply available, so that a detection unit 7*d*, 7*e*, which extends over the entire pane 3 or a substantial portion thereof, can be manufactured inexpensively. Modern manufacturing techniques also offer the possibility to produce sensors 8*d* and light sources 11*a* (for example in the form of light emitting diodes or LEDs), etc. very thin on a foil-like carrier. The entire detection unit 7*d*, 7*e* can therefore be provided as a foil-like strip that is simply glued to the inside of the pane 3. In this context, it is pointed out that new manufacturing techniques make it possible to produce circuits that are more or less transparent. Thus, such circuits are particularly suitable for application on a transparent pane 3. Of course, the central control unit 14, the memory 15, the radio interface 16, and possibly a battery, an accumulator or a storage capacitor (not shown) can be arranged in a rigid and/or opaque housing.

In an advantageous variant of the invention, the detection range of a sensor 8*d* may also be smaller than a light/dark area so that a misalignment of the sensors 8*d* or the detection unit 7*d*, 7*e* arising during installation, which shall not trigger an alarm, can be compensated. This measure is also advantageous if the detection unit 7*d*, 7*e* is arranged on the window 5 (see, for example the detection unit 7*a* in FIG. 7) and monitoring shall be done in both closed and slightly open (for example, tilted) state of the window 5.

If photodiodes are provided as sensors 8*d*, so there is also the possibility to operate them as solar cells during the day to supply the detection unit 7*a*, 7*b* with electrical energy for night operation. In this way, an energy supply with batteries can be avoided, or a battery replacement can be delayed at least. In this case the photodiodes fulfill a double benefit, on the one hand they act as an energy generator, on the other hand as a sensor.

The probability of a false alarm triggered by insects decreases with the number of the sensors 8*d* being used if an appropriate threshold between the actual pattern M and reference pattern for triggering an alarm is presumed. The variant of the invention presented in FIG. 11 therefore is particularly fault tolerant. For this variant again the Gray Code, which has already been mentioned, is suited very well, as well as the deviation of +/−1 between a captured reference value and an actual value as an acceptable threshold. If now an insect crawls over a bright area, then the digital number captured by the detection unit 7*a*, 7*b* changes only by the value 1. Because of the threshold of +/−1 still no alarm is triggered. Naturally, also a higher thresholds may be chosen to make the system more fault-tolerant. Of course, also all mixed forms of the variants of the invention presented in the FIGS. 1 to 11 are conceivable. Naturally, it is also conceivable to make a bright/dark area so large that a single insect crawling on it is negligible. The provision of a threshold value can be omitted then.

In order to further complicate spying out the pattern M, the pattern M can also be designed more complex than it actually would be necessary for the detection unit 7*d*, 7*e*, which means there are less sensors 8*d* than bright/dark areas. Even if a potential burglar manages to take a look at the pattern M, for example because he has temporary access to the building, it would be extremely difficult to determine the correct allocation of the sensor 8*d* to the bright/dark areas. Also, the provision of dummy sensors is conceivable for this purpose.

By selective, in particular random illumination of various bright/dark areas a further variation of the pattern M can be achieved to make a manipulation by a potential burglar more difficult. In this way, a bright area is deliberately not lit or a dark area illuminated very strong. A bright area thus becomes a dark area, and a dark area becomes a bright area.

Advantageously, even only a subset, in particular a randomly selected subset of all available sensors 8*d* can be activated at different times. In this way, the manipulation of the novel detection unit 7*d*, 7*e* can even get more complicated. For example, a potential intruder could try to cover sensor 8*d* by sensor 8*d* and see if an alarm is triggered. By varying the respective active sensors 8*d* it is veiled whether the taping actually has lead to a successful manipulation. Namely, if an inactive sensor 8*d* is taped, this could be wrongly interpreted by the offender as a successful manipulation. Of course, again an alarm is triggered if the sensor 8*d* in question is switched active the next time.

In a further preferred variant of the invention, the inventive device is combined with a device for repelling insects. For example, an insect trap can be arranged in the space between the closure element 6*a* . . . 6*d* and the window 5. Preferably, this is arranged off the detection unit 7*a* . . . 7*e*. For example, insects can be attracted by ultraviolet light and then killed by high voltage in a conventional manner. If necessary, a high voltage trap can also be arranged in the range of the light source 11*a*, especially if the light source 11 emits light in the ultraviolet range. With this addition, the inventive device can be made more fault tolerant.

Anyway, the conscious provocation of a false alarm by potential intruders, which only push up a shutter 6*a* . . . 6*d* without committing a burglary, does not remain undetected. On the one hand, of course, an alarm is triggered by the inventive apparatus. On the other hand, even a manually operated roller shutter 6*a* . . . 6*d*, which is pushed up from the outside, stays in an open position and cannot be closed from the outside. The same counts for an electrically operated roller shutter 6*a* . . . 6*d*, which also remains in an open position. The pattern "triggered alarm+partially opened shutter" therefore can undoubtedly be associated with a manipulation attempt.

In another variant of the invention the pattern M captured by the detection unit 7*d*, 7*e* may be additionally be analyzed in terms of its structure at the start of operation of the inventive apparatus. For example, the size of the different bright/dark areas of the pattern M arranged on the closure element 6*b* . . . 6*d* can each be provided as an integer multiple of a smallest light/dark area. In this case, the size of a smallest bright/dark area can be determined in an analysis phase. As a result, the detected pattern M can easily be divided into different areas.

FIG. 12 illustrates this principle. The left image shows the pattern M, which is captured by the detection unit 7*d*, 7*e* still unsegmented in an initial step. Therefore, simply bright/dark areas of different sizes are recorded. In a second step, the smallest bright/dark area is determined. The middle illustration shows the three bright/dark areas in question included in the pattern M in isolation. Based on the size of the smallest bright/dark area, the pattern M can be segmented as shown in the right illustration. Of course, also an average of the three bright/dark areas shown in the middle illustration can be used for the segmentation for example.

Advantageously, the inventive detection unit 7*d*, 7*e* can easily be adjusted to different patterns M, different detection angles and different distances between the closure element 6*a* . . . 6*d* and the detection unit 7*d*, 7*e* in this way. Thus, the installation of the inventive detection unit 7*d*, 7*e* is particularly simple.

Of course, also standardized codes can be used as a pattern M. The EAN bar code (ISO/IEC 15420), the 2/5-Interleaved-Code (ISO/IEC 16390), the Code 9 (ISO/IEC 16388), the Code 93 (ANSI/AIM BC5 1995) and Code 128 (ISO/IEC 15417) are presented as examples of one-dimensional codes. The Codablock, the PDF417, the QR-code (ISO/IEC 18004), the DataMatrix (ISO/IEC 16022), the MaxiCode, the Aztec code (ISO/IEC 24778) and the dot code are presented as examples of two-dimensional codes. In addition there are special codes such as the composite code (composed of a one-dimensional and two-dimensional code), stochastic codes and the RM4SCC. The advantage of using standardized codes inter alia is that standardized and therefore readily available readers can be used as a detection unit 7*a* . . . 7*e*, optionally by use of a conversion lens for widening the reading area.

The FIGS. 13 to 16 now show some possible variants of windows 5, which are equipped with sensors 8*e*. The sensors 8*e* can be of any type. In particular, the sensors 8*e* also can be of a type, which has already been mentioned in the previous examples. Each sensor 8*e* can be assigned to a dedicated detection unit 7 . . . 7*e*, or several sensors 8*e* are combined in a detection unit 7 . . . 7*e*. Of course, the variants shown in the Figures can be used in any combination.

Figure 13:
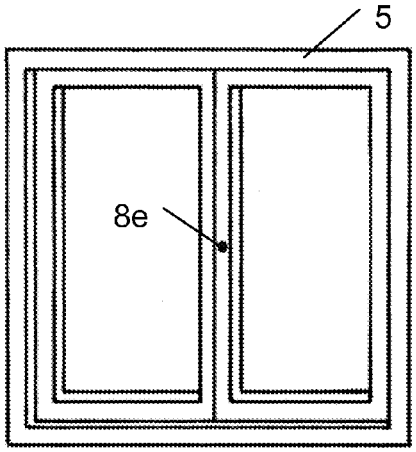
FIG. 13 shows a first embodiment of a sensor arrangement for a window.

For example, FIG. 13 shows a window 5 with a sensor 8*e* being arranged centrally in the frame. This sensor 8*e*, for example, can be a camera or an ultrasonic sensor with large angular coverage.

Figure 14:
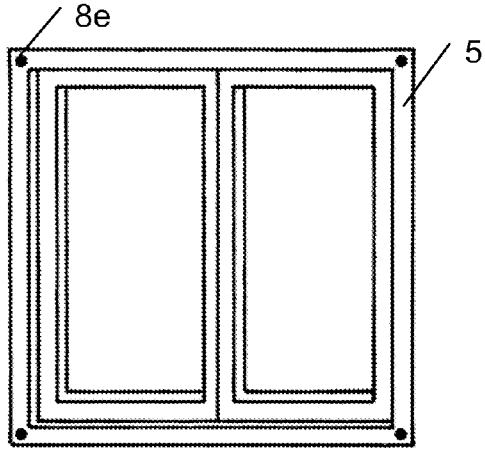
FIG. 14 shows a second embodiment of a sensor arrangement for a window.

FIG. 14 shows a window 5 with a sensor 8*e* being arranged in each corner of the frame. These need not necessarily be aligned perpendicular to the window 5, but can also slightly be tilted inwards for example.

Figure 15:
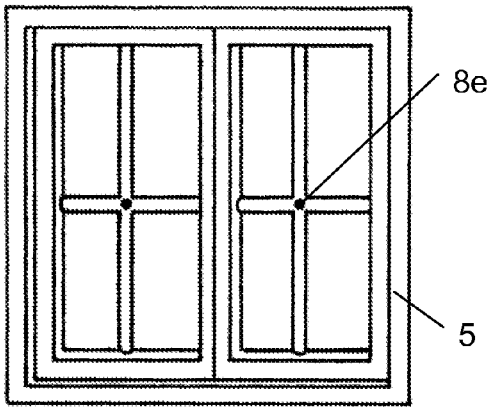
FIG. 15 shows a third embodiment of a sensor arrangement for a window.

FIG. 15 shows a variant with the sensors 8*e* being arranged in the window crosses. Again, these can be cameras and ultrasonic sensors for example. In particular, the window cross may be sandwiched between two panes. In this way the sensors 8*e* are reliably protected against tampering and contamination.

Figure 16:
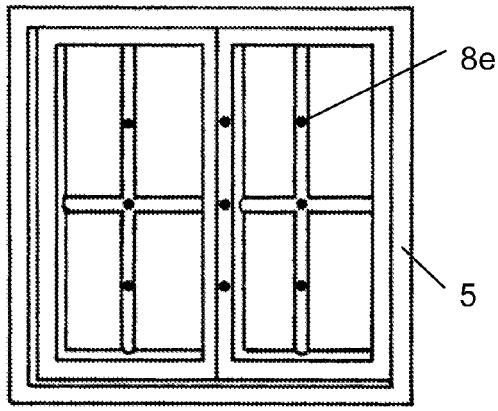
FIG. 16 shows a fourth embodiment of a sensor arrangement for a window.

FIG. 16 finally shows a variant of a window 5, wherein a total of nine sensors 8*e* is provided. For example, each of the sensors 8*e* can detect one bright/dark area of a pattern M (similar to the pattern M shown in FIG. 8). For example, the sensor 8*e* may be a photodiode or a phototransistor. In this way, 512 different combinations can be achieved. A manipulation of the invention device is virtually impossible because an offender would have to selectively mask the right sensors 8*e*.

Advantageously, the photodiodes can also be used for energy generation as has been mentioned. In this case it is advantageous if the photodiodes have a large collection angle, so that light can be converted into electrical energy from as many as possible directions. For scanning a defined area of the shutter 6*b* . . . 6*d* anyway, such a photodiode preferably is combined with a light source with a small beam angle, especially with an LED in the visible or infrared wavelength range. This illuminates only a small portion of the shutter 6*b* . . . 6*d*, so that also the signal received by the photodiode is only or predominantly based on this area.

In a further preferred embodiment of the invention, at least one sensor 8*a* . . . 8*e* is directed onto the shutter 6, so that only a portion of the shutter 6 is monitored and the other portion of the shutter 6, which is not monitored by the at least one sensor 8*a* . . . 8*e*, is smaller than a trapdoor opening of an intruder. If it is assumed for example, that a potential burglar needs a manhole of at least 40 cm in diameter, so monitoring of a border <40 cm of the shutter 6 by the at least one sensor 8*a* . . . 8*e* can be omitted without the risk that a burglar remains undetected. Additionally or alternatively, monitoring of other areas of <40 cm in diameter by the at least one sensor 8*a* . . . 8*e* can be omitted.

Figure 17:
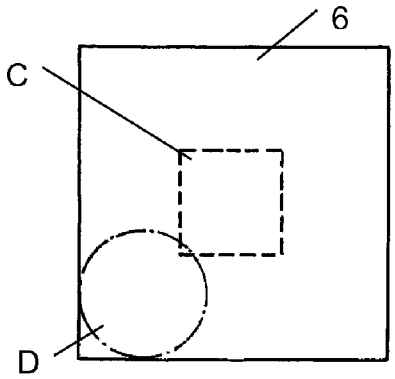
FIG. 17 shows a first option for a reduced detection range of a detection unit or a camera

In this context, FIG. 17 shows a possible variant, in which only a central area C of the shutter 6 is monitored by a sensor 8*e*. Nevertheless, a trapdoor opening D of an intruder, which has to have a minimum size (about 40 to 50 cm in diameter) is reliably detected.

Figure 18:
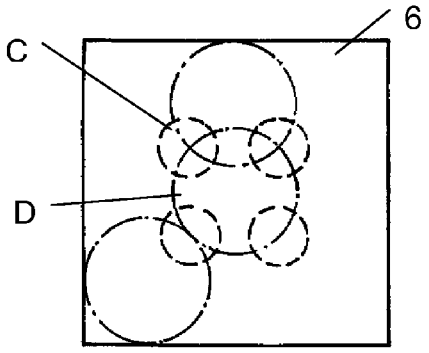
FIG. 18 shows a second option for a reduced detection range.

FIG. 18 shows a further variant, in which four areas C of the shutter 6 are monitored, preferably by four sensors 8*e*. However, it is still impossible to make a trapdoor opening D without triggering an alarm as easily can be seen in FIG. 18. Pushing up the shutter 6 is useless anyway, as also an alarm is triggered.

Figure 19:
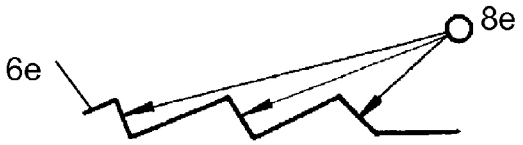
FIG. 19 shows a first surface structure of a shutter, which improves signal reflection.

FIG. 19 shows how the reflection characteristics of a shutter 6*e* deliberately can be improved. For this reason, the shutter 6*e* comprises a spatial structure, which enhances the reflection of a signal transmitted by at least one sensor 8*e* back to said sensor 8*e*. Hence, grooves are formed in the shutter 6*e*, which in a particularly preferred embodiment have such an inclination that the signal is perfectly reflected. FIG. 19 shows the cross section of some of these grooves, which provide selective reflection of a visual or audible signal back to the sensor 8*e* by the right side surfaces of the grooves being oriented normal to each sensor 8*e*.

Figure 20:
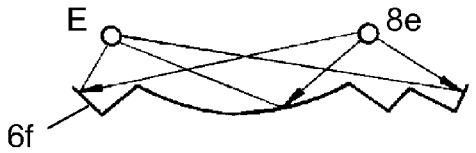
FIG. 20 shows a second surface structure for improved signal reflection.

FIG. 20 shows a variant of the shutter 6*f*, where the signal emitted from a sensor 8*e* is selectively reflected to a receiving point E. For example, an ultrasonic sensor from a set of ultrasonic sensors can send out a signal, which shall be routed to another ultrasonic sensor. To this end, the shutter 6*f* comprises also grooves with varying inclination, especially with elliptical profile in sections. An ellipse is characterized in that radiation emanating from one focal point is focused in the other focal point.

In another variant of the invention not the shutter 6*e*, 6*f* itself is provided with grooves, but for example labels are attached, which exhibit a desired reflectance. In this way, a pattern M can be realized by selectively attaching such stickers.

Figure 21:
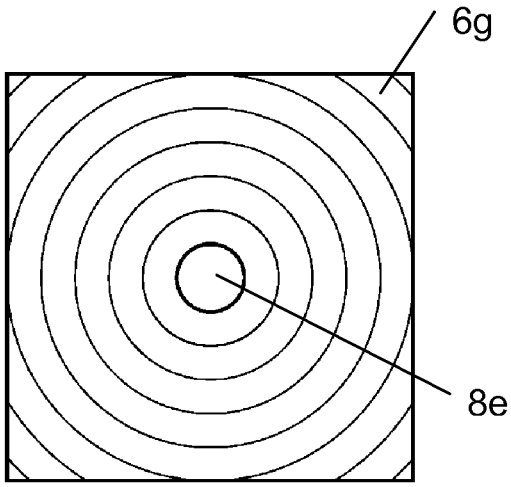
FIG. 21 shows a top view of a shutter with a groove structure with a centrally arranged sensor.

FIG. 21 shows how the aforementioned grooves can be arranged in a plan view of a shutter 6*g*. In this example, a sensor 8*e* is provided in the center (see also FIG. 13). This may be a camera with a wide angle or fisheye lens, a PIR sensor with wide detection angle, or even an ultrasonic sensor with wide detection angle. Especially in the latter case it is important that a transmitted signal is reflected sufficiently well to be able to detect a meaningful "sound image" of the shutter 6*g*. For this reason, grooves in the form of concentric circles are provided in this variant, which for example have the profile shown in FIG. 19.

By covering the profile with a foil or by selectively grinding the same, areas of the shutter 6*g* can be made "black" optically or acoustically (i.e. absorbing or scattering), so as to realize a pattern M. Similarly, a "black" shutter 6*g* can be made reflective in certain areas by attaching said profile.

Figure 22:
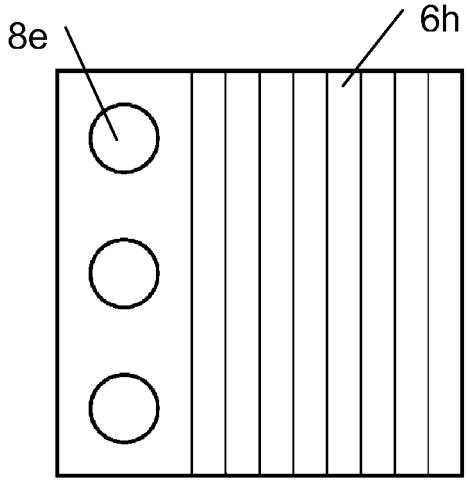
FIG. 22 shows a top view of a shutter with a groove structure with side-mounted sensors.

FIG. 22 shows a further variant of a shutter 6*h* with three sensors 8*e* being arranged on the left side of the shutter 6*h*. Of course, also more sensors 8*e* can be used. In particular, a detection unit 7*a* . . . 7*e* can be realized in that a series of sensors 8*e* (e.g. light-sensitive cells) are located at the edge of the pane 3 of the window 5. In this way, a kind of a line sensor is created. Accordingly, vertical grooves are provided in this variant (for example again with the profile of FIG. 19).

In another variant, more rows of sensors 8*e* are arranged at the edge of the window pane 3, each being directed to different vertical areas of the shutter 6*h*. For example, a first set of sensors 8*e* can scan the left side of the shutter 6*h*, a second, slightly inclined line the central area of the shutter 6*h*, and a third, even more inclined line the right side of the shutter 6*h*. Instead of an inclination also a suitable optical system, which deflects the light beam accordingly, can be provided.

In this way, for example, the entire roller shutter 6*h* can be scanned by sensors 8*e*, which are located on the left side of the window pane 3 and therefore allow an unobstructed view through the window 5. By the groove structure of shutter 6*h* also a signal from the right side of the shutter 6*h* is still reliably reflected back to the left border. Such a bar-shaped detection unit 7*a* . . . 7*e* is also particularly suitable for retrofitting, because it can be glued to the inside of the pane 3 for example.

Figure 23:
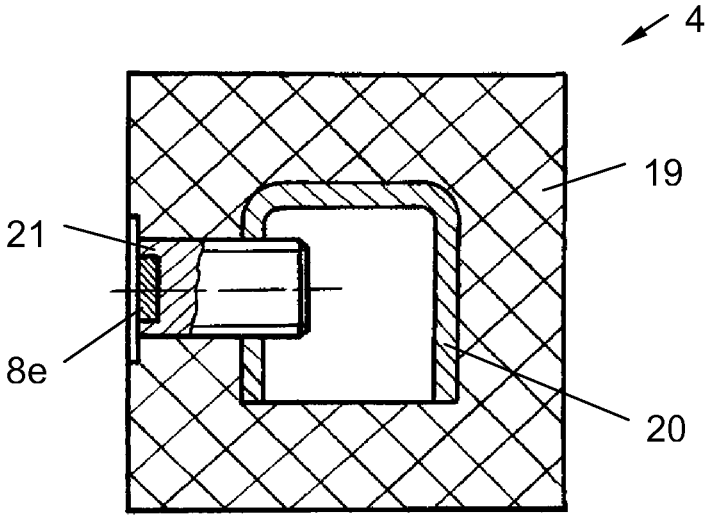
FIG. 23 shows a variant of a sensor for installation in a window frame.

FIG. 23 now shows how a sensor 8*e* can be installed in a window frame 4. The window frame 4 comprises a plastic body 19 with a steel core 20. In this example, the plastic body 19 is shown strongly simplified and can form a part of the window frame 4 or the window post. In general, said plastic body 19 has a rather complicated profile. The sensor 8*e* is embedded in a sensor holder 21, which is threaded in this example. Preferably, the sensor holder 21 is screwed to the steel core 20 and fixed there, for example, by wetting the thread with adhesive before screwing. In this way, the tearing out of the sensor 8*e* gets difficult. Of course, the sensor holder 21 can be fixed in the window frame 4 also in another way, for example, with the help of a snap connection. Preferably, the sensor holder 21 after assembly is flush with the surface of the plastic body 19 or even slightly offset to the inside as in this example. In this way, the violent tearing out of the sensor 8*e* is further complicated. In a further variant, a stable glass plate is provided in front of the sensor 8*e* in order to further protect the sensor 8*e*. The sensor holder 21 can be mounted in a wooden window in a similar way, i.e. for example by screwing and gluing. It should be noted, however, that wood windows usually have no steel core 20.

Figure 24:
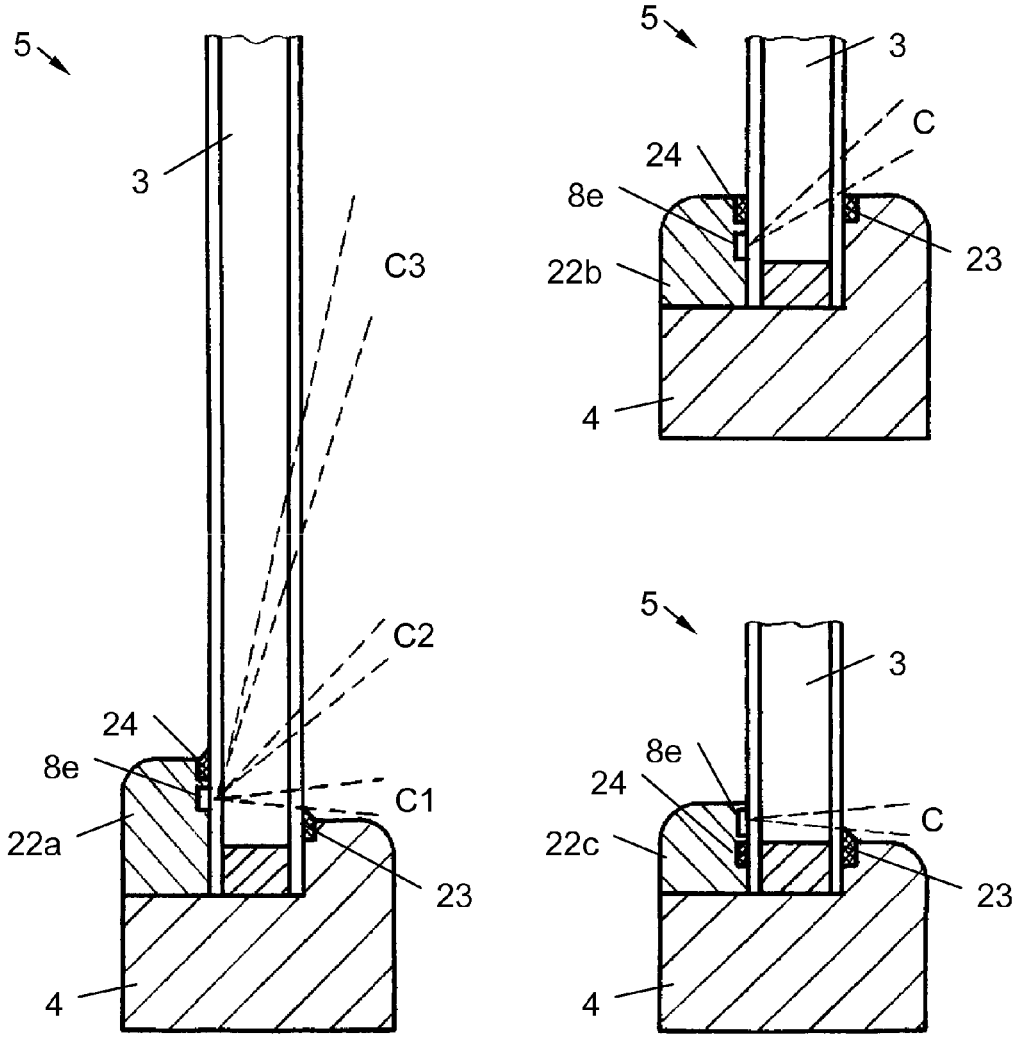
FIG. 24 shows several variants with a sensor in a glazing bead of a window.

FIG. 24 shows some variations how a sensor 8*e* can be installed in a glazing bead 22*a* . . . 22*c* of a window 5. In the left illustration, the window frame 4 of a window 5 can be seen. An (insulation glass) pane 3 is inserted into this frame 4 and sealed against the frame 4 with a seal 23. The pane 3 is held in the window frame 4 by means of glazing beads 22*a*, which form a frame, and is sealed against the glazing beads 22*a* with a seal 24. This arrangement is known per se and is used for a long time for the manufacture of windows 5.

According to the invention, a sensor 8*e* is inserted into the glazing bead 22*a* or into the frame formed by the same. This sensor 8*e* may be formed by a photodiode, a phototransistor, a photoresistor, a CCD line sensor, a CMOS sensor or the like for example as already has been mentioned. In the left illustration, the glazing bead 22*a* is slightly higher than the frame 4 so that the sensor 8*e* can detect the range C1 for example. Of course, the sensor 8*e* can also scan the areas C2 or C3, depending on the installation direction or optics used.

In this example, the sensor 8*e* is arranged on the frame side in relation to the seal 24. Advantageously, the sensor 8*e* is perfectly protected from contamination and mechanical damage in this way. Nevertheless, it is easily accessible for maintenance insofar the glazing beads 22*a* are constructed to be removable to easily exchange the pane 3 for example. Moreover, the sensor 8*e* is well protected from the outside, for example, against access by a potential burglar. Because the sensor 8*e* can also be aligned inclined, a taping of the sensor 8*e* is very difficult for a potential burglar. Anyway, he cannot do this without attracting attention, because for covering the detection ranges C2 and C3 he would have to cover an area in the middle of the pane 3, which of course is very conspicuous.

The upper right illustration shows a further variant of a window 5 that is very similar to the window 5 of the left illustration. In contrast, the glazing bead 22*b* is designed as high as the frame 4 here. Nonetheless, the sensor 8*e* can scan the area C for example, passing the frame 4 in an inclined direction.

The right lower illustration shows a further variant of a window 5 that is very similar to the window 5 of the left illustration. In contrast, the sensor 8*e* here is arranged on the opposite side of the frame 4 in relation to the seal 24. Under certain circumstances, the glazing bead 22*c* can be made a bit lower in this way.

In the examples shown, all four glass glazing beads (for example all three glass beads in case of triangular windows 5) may have the same profile or different profiles. Since glazing beads are usually as high as the window frame 4 it is conceivable especially for windows 5 of the left illustration and bottom right illustration that, for example, only one of the glazing beads 22*a* and 22*c* has the shown profile and includes sensors 8*e*, while the rest of the glazing beads of the frame are of conventional construction.

Figure 25:
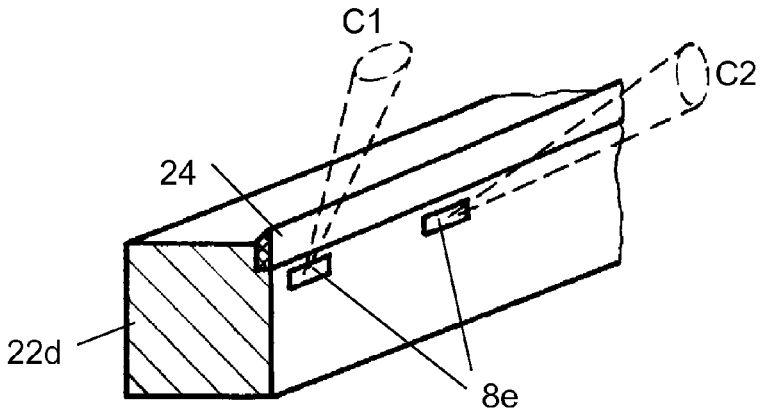
FIG. 25 shows an exemplary glazing bead seen at an angle from above.

FIG. 25 now shows that also more sensors 8*e* can be arranged in a glazing bead 22*d*, which sensors 8*e* are aligned differently and scan the detection ranges C1 and C2 for example. Consequently, area C1 would rather lie in the center of a shutter 6 . . . 6*h*, the detection range C2 rather at the edge area of the shutter 6 . . . 6*h*.

Figure 26:
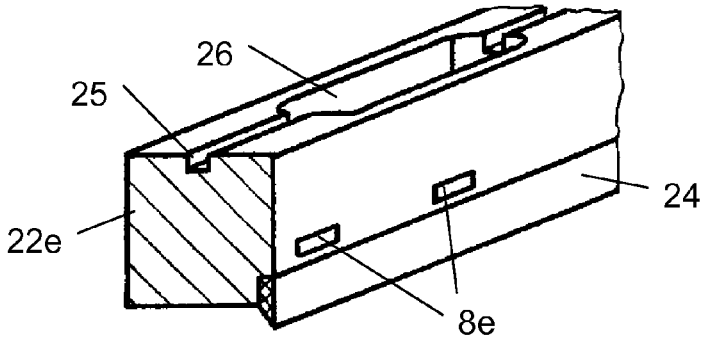
FIG. 26 shows an exemplary glazing bead at an angle from below.

FIG. 26 shows a glazing bead 22*e* from the bottom side. Into the material of the same (e.g. wood) a cable channel 25 is milled as well as a recess 26, which may carry the whole circuit shown in FIG. 4 or 5 for example as well as an energy supply. Of course, the recess 26 can also be sealed with a lid. It is also conceivable that the recess 26 remains accessible through an (additional) outer cover, even when the glazing bead 22*e* is mounted, for example, to replace a battery.

Figure 27:
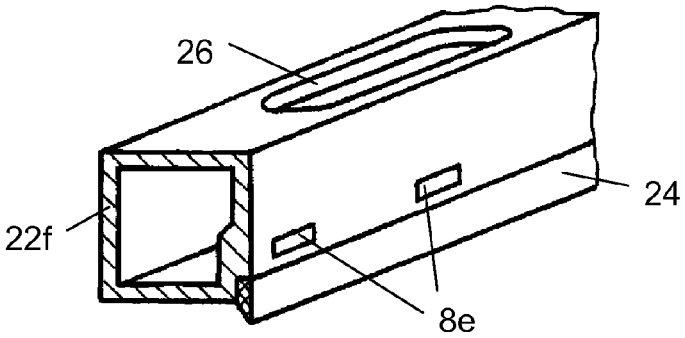
FIG. 27 shows a glazing bead consisting of a hollow profile.

In the above examples it was assumed that the glazing beads 22*a* . . . 22*e* are made of solid materials, especially wood. FIG. 27 shows a variant in which the glazing bead 22*f* is formed from a hollow profile. This design is particularly useful for windows made of plastic or aluminum. Since the cavity can be used for carrying the cable, a separate cable channel may be omitted. Of course, also the glazing bead 22*f* may have a recess 26 for carrying an electronic circuit.

At this point, note that the measures shown in the FIGS. 26 and 27, i.e. the provision of a cable channel 25 and a recess 26 for carrying electrical and electronic components, can be beneficial regardless of the sensors 8*e* used in the context of this invention and therefore can form the basis of an independent invention.

Figure 28:
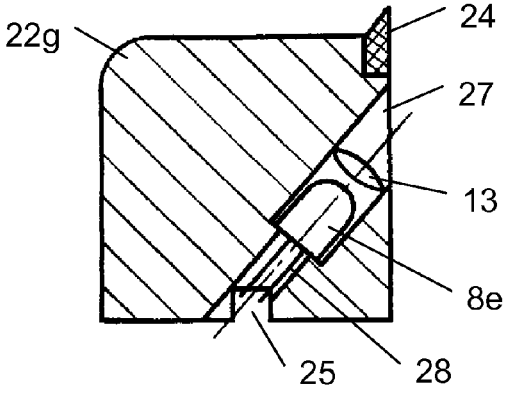
FIG. 28 shows another variant of a sensor installation in a glazing bead made of solid material.

FIG. 28 now shows a specific embodiment of a glazing bead 22*g*, which again is made of a solid material and again comprises a seal 24 and a cable channel 25. To use a sensor 8*e* an inclined hole 27 may be drilled, which extends to the cable channel 25. Also the connecting wires 28 for the sensor 8*e* can run through these holes 27. Moreover, a lens 13 or a more complex optics may be arranged in front of the sensor 8*e*. Of course, a light source 11*a* can be inserted into the hole 27 instead of the sensor 8*e*. Furthermore, it is conceivable that a number of sensors 8*e* respectively light sources 11*a* are arranged in the glazing bead 22*g* seen in its longitudinal direction, especially directed into different directions.

Figure 29:
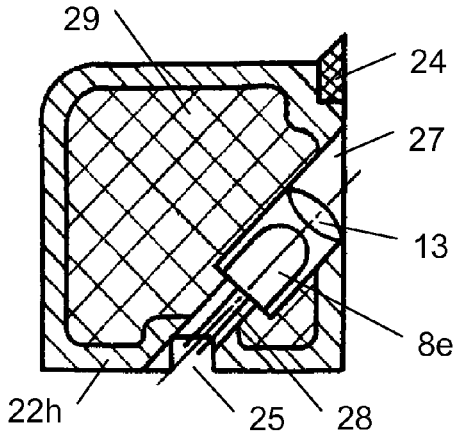
FIG. 29 shows a variant of a sensor installation in a glazing bead made of a hollow profile.

FIG. 29 shows another variation of a glazing bead 22*h*, which is very similar to the glazing bead 22*g* shown in FIG. 28. However, the glazing bead 22*h* again is formed from a hollow profile, especially from a plastic or aluminum profile. For easier installation of the components in a detection unit 7*a* . . . 7*e* and because of heat-technical reasons of course, this glazing bead 22*h* is filled with foam 29. Often, such a core already exists because of heat-technical reasons, and can now fulfill a dual purpose. Advantageously, the foam 29 or in general the surface of the hole 27 is colored black in order to reduce the influence of stray light. Of course, this measure is not only advantageous in the context of glazing beads 22*g*, 22*h*, but generally for cases of detection units 7*a* . . . 7*e*.

A particular advantage of using a glazing bead 22*a* . . . 22*h* is that the manufacture of the window 5 is not much more complicated, because the pane 3 is inserted into a frame 4 and secured against falling out by means of a glazing bead 22*a* or 22*h* respectively a glazing frame anyway like it is with a conventional window 5. Existing work processes need not to be modified substantially, instead of a conventional glazing bead merely an inventive glazing bead 22*a* . . . 22*h* is used.

Advantageously, also an existing glazing frame can be replaced by a new and inventive one. In this way, also existing windows 5 can be retrofitted with the inventive system without too much effort and without changing or significantly changing the appearance of the window 5. Experience shows that acquisition units respectively alarm devices 7*a* . . . 7*e* being mounted in addition are accepted by consumers only reluctantly. Moreover, obvious security measures are often perceived as disadvantageous because they are immediately recognized by a potential intruder, whereupon he can adapt his course of action.

Figure 30:
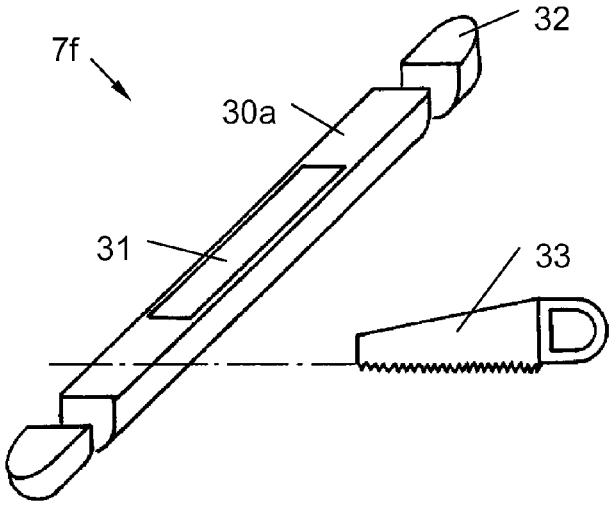
FIG. 30 shows a variant of a detection unit or an alarm sensor unit that can be easily adapted to the size of a window.

FIG. 30 shows a further variant of the invention in the form of a detection unit 7*f*. This includes an oblong profile part 30*a* and end caps 32 at its ends, which prevent the ingress of dust and moisture. The profile part 30*a* has rounded edges and is therefore easy to clean. In or on the profile part 30*a* components being essential for the invention are arranged such as sensors 8*e*, light sources 11*a*, lenses 12 and 13, a central control unit 14, a memory 15, a radio interface 16, a solar cell 9 and the like. These are located in a central region 31 of the profile part 30*a*. The end portions of the profile part 30*a*, however, remain free of electronic components. In this way, it is possible to adapt the length of the detection unit 7*f* to the size of a window 5 by cutting the profile part 30*a* with a saw 33 for example.

Figure 31:
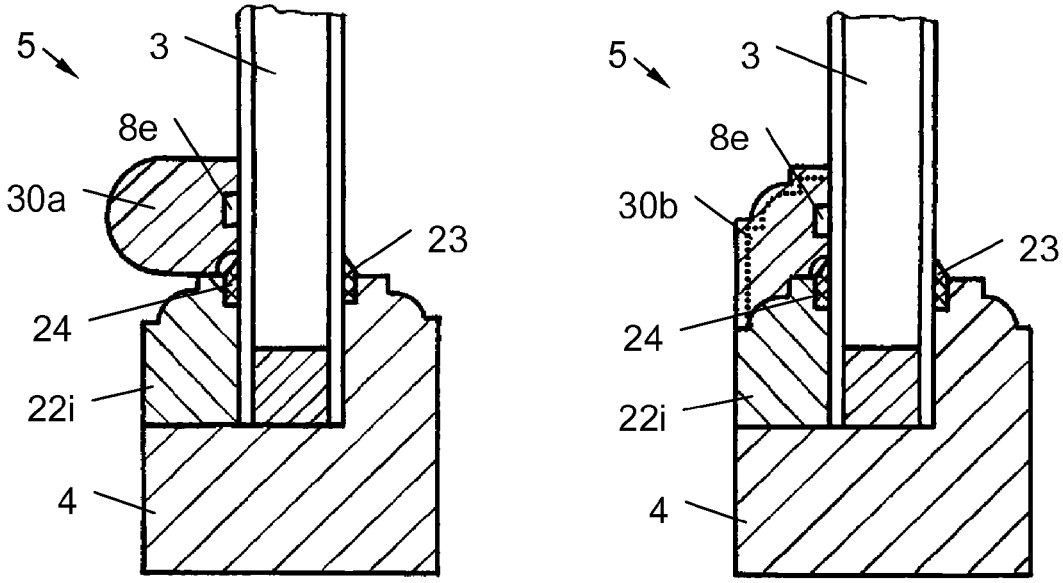
FIG. 31 shows two types of alarm sensor units with different profile parts.

In the left image of FIG. 31 the profile part 30*a* being mounted on a window 5 is shown. Although the profile part 30*a* is easy to clean as such, in the left illustration a narrow gap can be seen between the profile part 30*a* and the glazing bead 22*i*, where dirt can accumulate easily. Therefore, the profile part 30*b* of the right part of the illustration can be provided as an alternative to the profile part 30*a*. This has the same profile as the glazing bead 22*i*, one positive and one negative, and therefore perfectly fits to an (existing) glazing bead 22*i*. As can be recognized easily, there are no gaps any longer, in which dirt could accumulate. Thus, the window 5 in the right illustration is easy to clean. Optionally, merely a cover may be provided to hold off dirt and moisture from the electronic circuit (see the dotted line in the right illustration). The solution shown in the right illustration is also particularly suitable for equipping a window 5 with the inventive system without significantly changing the appearance of the window 5.

In a preferred embodiment of the invention additional sensors can be incorporated in a detection unit 7*a*, 7*b*, for example, glass breakage sensors, acceleration sensors, etc. Furthermore, a reed switch, which detects the opening of a window 5 in a conventional manner, may be connected to the detection unit 7*a* . . . 7*e*. By the integration of additional sensors, for example, the central control unit 14, the memory 15 and the radio interface 16 can be used multiple times. The monitoring of a shutter 6*a* . . . 6*h* and a window 5 can be handled from a single detection unit 7*a* . . . 7*e*. Alternatively, the opening of the window 5 can be monitored by position sensors such as magnetic field sensors. Advantageously, the detection unit 7*a* . . . 7*e* can be kept very compact then since no parts or wiring protrudes out of the pane 3 of the window 5, as is the case when integrating reed contacts.

For very large, multi-leaf windows 5, it may be advantageous to install detection units 7*a* . . . 7*e* on several window sashes or on each window sash. This counts even more when glass breakage sensors are integrated in the detection units 7*a* . . . 7*e* for example. For communication between the individual detection units 7*a* . . . 7*e* a wired connection, a radio link, an inductive coupling, or an optical communication link can be provided. In the closed state of the window 5, the communication link for example is accomplished by contacts, which are integrated in the window 5 or which are mounted thereon, touching each other. It is also conceivable that an optical transmitter and an optical receiver face each other when the window 5 is closed. Likewise, a sending coil and a receiving coil of an inductive coupling can face each other when the window 5 is closed, so that a communication of the detection units 7*a* . . . 7*e* with one another is possible. In this way, the central control unit 14, the memory 15 and the radio interface 16 for example, need to be provided just once and can be used multiple times by connecting sensors 8*e* of several sashes to them.

Advantageously, a broken communication link can be associated with the state "open window", and a corresponding alarm be triggered thereupon. In this way, dedicated sensors for the detection of an open window 5 can be saved or be used for a plausibility check. For example, an alarm is only triggered if a communication link is interrupted and a designated (position) sensor indicates an open window 5.

In a similar manner and with the same functionality of course also a communication link can exist between a (moving) window sash and a fixed part of the building, for example, the wall 2 or the window frame 4. Also in this case, a broken communication link indicates an open window 5.

For example, a detection unit 7*a* . . . 7*e* arranged on a sash may also include a reflective light barrier, wherein the reflector is arranged on a different window sash, the frame 4 or the wall 2. In addition, the detection unit 7*a* . . . 7*e* comprises a magnetic field sensor, which detects the magnetic field. If this sensor detects a change, then the window 5 has been opened. Since such a magnetic field sensor can be manipulated relatively easily by a magnetic field, alarm is only triggered, even if the reflected light beam from the light barrier cannot be detected any longer. In this way a manipulation by means of magnets is prevented, on the other hand, also for example insects, which interrupt the light beam, do not trigger a (false) alarm. Advantageously, a compact detection unit 7*a* . . . 7*e* can be realized in this way, which unifies all essential monitoring functions in one device, especially if it includes a glass break sensor.

In the previous examples it was assumed that a pattern M is arranged on the side of the closure element 6, 6*a* . . . 6*h* facing the inside of the building respectively the window 5 or is projected thereon. This is not a necessary condition. The acquisition of the pattern M can also occur in the closure element itself, if it is hollow, as it usually is the case for the slats/lamellas of a shutter for example.

Figure 32:
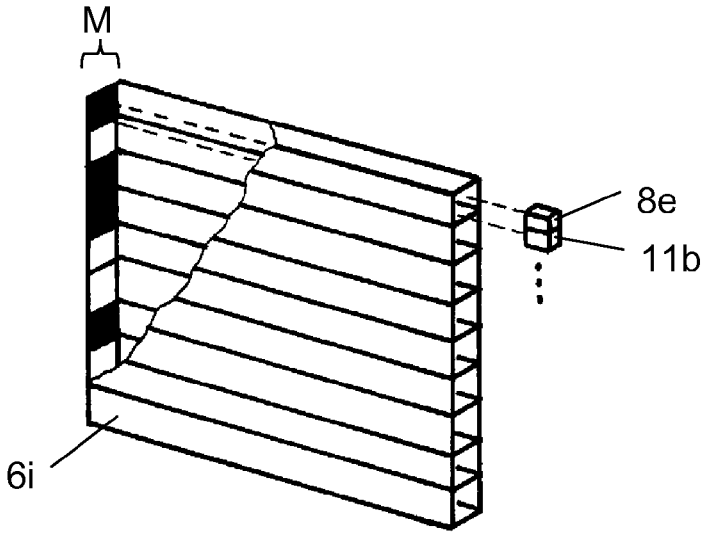
FIG. 32 shows a variant with a pattern provided within a shutter.

FIG. 32 shows an example, in which the lamellas of a shutter 6*i* are formed by hollow profiles. The hollow profiles are closed on one side and comprise a pattern M on the inside of the shutter 6*i*. A number of fixed light sources 11*b* and fixed sensors 8*e* are arranged at the other side, for example in a guide rail of the shutter 6*i*. The light sources 11*b* illuminate the opposite surface of the shutter 6*i* and the sensors 8*e* receive a signal for a dark or bright area. In principle, the entire inner surface of a lamella can be made bright or dark for this reason or even the side surface (in FIG. 32 the left edges). Of course, mixed forms are conceivable.

Figure 33:
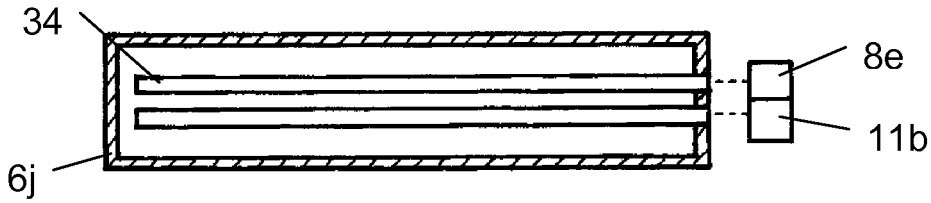
FIG. 33 shows a variant of the invention with light guides provided in the lamellas of the shutter.

FIG. 33 shows another variant of the invention in the form of a single lamella, in which two light guides 34 are arranged in order to improve the detection of the pattern M. The left inside of the lamella is again implemented as a bright or dark area.

Figure 34:
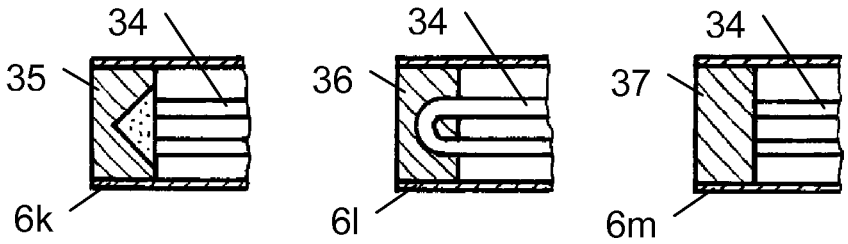
FIG. 34 shows different variants for closing the lamella of a shutter respectively the optical fibers disposed therein and FIG. 35 shows a shutter with a pattern on one of its side faces.

Alternatively, as it is shown in FIG. 34, the left inside may be formed by a prism or a mirror (see the prism/mirror lid 35 in the left illustration), by a light guide bow (see the light guide cover 36 in the middle illustration) or by a dummy cover or blind cover 37 (right illustration). The last embodiment thus corresponds to a dark area (light emitted by the light source 11*b* does not reach the sensor 8*e*), the other embodiments correspond to a bright area (light emitted by the light source 11*b* reaches the sensor 8*e*). Of course, a roller shutter 6*j* . . . 6*m* comprises more of the illustrated lamellas. Preferably, all the lamellas of a shutter 6*j* . . . 6*m* are equipped in the presented way, but is also conceivable that the lamellas are combined with conventional lamellas.

If the shutter 6*i* . . . 6*m* is shifted now or lamellas are ripped out, then the pattern M detected by the sensors 8*e* changes. If the shutter 6*i* . . . 6*m* is cut open, so light falls onto the sensors 8*e* during the day, or the detection of the pattern M is disturbed by a blade reaching into the shutter 6*i* . . . 6*m*, which also triggers an alarm. Another advantage is that an interior pattern M is not recognizable by a potential burglar, why a manipulation of the arrangement again is very difficult to impossible. To do so, he had to reproduce the pattern M being invisible to him directly onto the fixed sensors 8*e*. Advantageously, the entire arrangement is also well protected against dirt.

Figure 35:
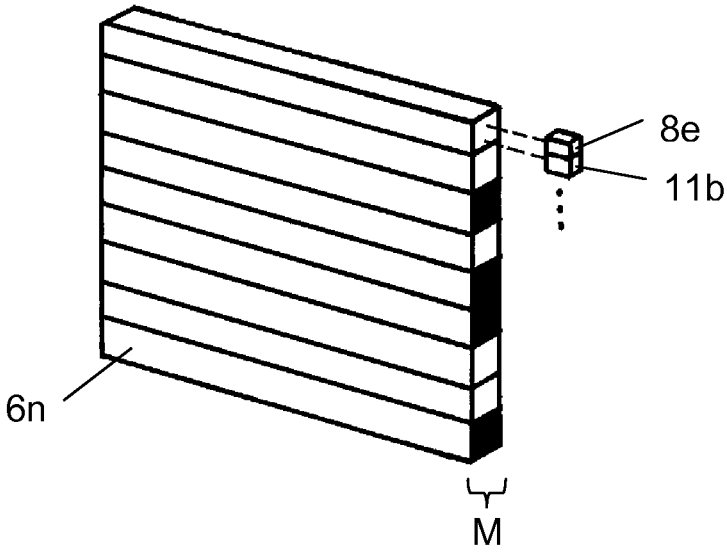

In principle, the pattern M can also be shifted in the direction of the sensors 8*e* (i.e. it may be arranged in the middle of the shutter 6*i* . . . 6*m* for example) or be arranged on the outside of the shutter facing the sensors 8*e*. To this end, FIG. 35 shows an appropriate example of a shutter 6*n*. Since the shutter 6*i* . . . 6*n* runs in guide rails, again the pattern M cannot be identified by an offender. However, cutting open the shutter 6*n* is no longer recognized or recognized only limited then.

The teaching, which was disclosed in relation to the variants of the invention with a pattern M that is arranged on the side of the closure element 6*a* . . . 6*h* facing the inside of the building or the window 5, mutatis mutandis applies to the variants of the invention with an interior pattern M. In particular, the pattern M does not have to be segmented like the lamellas, but can also be provided across the lamellas. It is also conceivable that other sensors than optical sensors 8*e* are used for interior patterns M, for example, ultrasonic sensors.

In the previous examples it was often assumed that the pattern M is formed by bright and dark areas. Of course, the pattern M can also be formed by different colors, for example, by red, green and blue areas, so as to make the manipulation of the inventive arrangement even more difficult.

The invention has been explained by means of a shutter 6*a* . . . 6*n*. Of course, the inventive teaching also applies to roller doors, blinds (jalousies), raffstore blinds, fabric roller blinds, folding shutters and doors without changes or with just minor changes that however are within the skill of the art (in case of roller shutters, roller doors, blinds, raffstore blinds and fabric roller blinds a pattern M arranged thereon is shifted, in case of folding shutters and doors it is folded away). In the case of doors and roller doors, an additional barrier in the form of a window or the like is usually lacking. That is why it is more important to monitor unauthorized access to the same.

Finally, it is noted that the functions being necessary for the implementation of the inventive method may be embodied in software and/or in hardware. For example, said function can be formed by a program stored in a memory 16, which is loaded in a processor and executed there at run time. It is also conceivable that the function is set up with various integrated circuits. Finally, also a realization in the form of an ASIC (Application Specific Integrated Circuit) is conceivable for example.

Finally, note that the individual variants shown in the Figures can also form the basis of independent inventions.

List of reference numerals

| | |
|---|---|
| 1a . . . 1d | inventive arrangement |
| 2 | wall |
| 3 | pane |
| 4 | window frame |
| 5 | window |
| 6, 6a . . . 6n | closure element (shutter) |
| 7a 7f | detection unit |
| 8a 8e | sensor |
| 9 | solar cell |
| 10 | adhesive surface |
| 11a, 11b | light source |
| 12 | lens |
| 13 | lens |
| 14 | central control unit |

-continued

| List of reference numerals | |
|---|---|
| 15 | memory |
| 16 | radio interface |
| 17 | camera |
| 18 | lens |
| 19 | plastic body |
| 20 | steel core |
| 21 | sensor mount |
| 22a . . . 22i | glazing bead |
| 23 | seal |
| 24 | seal |
| 25 | cable channel |
| 26 | recess |
| 27 | hole |
| 28 | connection wires |
| 29 | foam |
| 30a, 30b | profile part |
| 31 | medium section of the profile part |
| 32 | end cap |
| 33 | saw |
| 34 | fiber optic |
| 35 | prism cover/mirror cover |
| 36 | fiber optic cover |
| 37 | blind cover |
| B | captured actual image |
| C, C1 . . . C3 | sensing area |
| D | trapdoor opening for burglars |
| E | receiving point |
| L | length of the closure element |
| M | pattern |
| x | direction of movement of the closure element |

The invention claimed is:

1. A device for monitoring a building's opening, which is sealed with a non-completely transparent closure element, comprising:

a detection unit directed to a pattern and a comparison unit for comparing an actual pattern detected by the detection unit with a reference pattern and for triggering an alarm if the deviation between the actual pattern and the reference pattern exceeds a predetermined threshold, characterized in that said pattern is essentially arranged on/in said closure element or projected onto/into said closure element.

2. The device according to claim 1, wherein a bar code/two-dimensional code is provided as a pattern, a bar code reader/a reader for a two-dimensional code is provided as a detection unit and that the comparison unit is provided for comparing an actual code with a reference code.

3. The device according to claim 1, characterized in that an image of a scene is provided as a pattern, a camera directed to said image is provided as a detection unit and that the comparison unit is provided to compare an actual image with a reference image.

4. The device according to claim 1, characterized in that the pattern substantially extends over an entire length of the closure element seen in a movement direction of the closure element.

5. The device according to claim 1, characterized in that the pattern, which is provided for being captured by the detection unit, substantially extends over an entire area of the closure element.

6. The device according to claim 1, wherein an area being detected by the detection unit covers a portion of the closure element, and the non-observed portion is smaller than a trapdoor opening of a burglar.

7. The device according to claim 1, wherein the detection unit is provided for being mounted on or behind a transparent pane arranged between the closure element and the detection unit.

8. The device according to claim 1, wherein the closure element comprises a spatial structure or such a structure is attached to said element in such a way that a signal emitted by the detection unit is directed back to the detection unit and/or directed to a receiving point.

9. The device according to claim 1, characterized by means to influence an actual signal detected by the detection unit and means for checking whether the actual signal detected by the detection unit changes upon activation and/or deactivation of the influencing means and for triggering a fault signal when the result of the check is negative.

10. The device according to claim 9, wherein the checking means are designed to check the strength of the influence and/or place of the influence and/or the distribution of influence caused by the influencing means.

11. The device according to claim 9, wherein the checking means are designed to check whether the actual signal detected by the detection unit synchronously changes with the activation and/or deactivation of the influencing means in the form of a binary code.

12. The device according to claim 1, characterized in that the pattern is arranged on a side of the closure element facing the wall.

13. The device according to claim 1, wherein the closure element is hollow and the closure element comprises a pattern on its inner side.

14. The device according to claim 1, wherein the detection unit is integrated in a glazing bead of a window, which window is located in front of the closure element in relation to the building.

15. A method for monitoring a building's opening by a device, which opening is closed by a non-completely transparent closure element, comprising the steps of:

a detection unit capturing a pattern essentially arranged on/in the closure element or projected onto/into said closure element, a comparison unit comparing an actual pattern detected by said detection unit with a reference pattern and triggering an alarm if the deviation between the actual pattern and the reference pattern exceeds a predetermined threshold.

* * * * *